US006521585B1

(12) United States Patent
Yamashita et al.

(10) Patent No.: US 6,521,585 B1
(45) Date of Patent: Feb. 18, 2003

(54) METHOD FOR PRODUCING CRYSTALLINE ALKALI METAL SILICATE GRANULES AND GRANULAR HIGH DENSITY DETERGENT

(75) Inventors: Hiroyuki Yamashita, Wakayama (JP); Shu Yamaguchi, Wakayama (JP); Teruo Kubota, Wakayama (JP); Katsuhiko Kasai, Wakayama (JP); Shigeru Tamura, Wakayama (JP); Masaki Tsumadori, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/068,476

(22) PCT Filed: Oct. 31, 1996

(86) PCT No.: PCT/JP96/03210

§ 371 (c)(1),
(2), (4) Date: May 6, 1998

(87) PCT Pub. No.: WO97/17422

PCT Pub. Date: May 17, 1997

(30) Foreign Application Priority Data

Nov. 6, 1995 (JP) ..... 7-313609
Nov. 15, 1995 (JP) ..... 7-322204

(51) Int. Cl.[7] ..... C11D 11/00; C11D 3/08; C11D 3/12; C11D 17/06

(52) U.S. Cl. ..... 510/444; 510/351; 510/356; 510/357; 510/361; 510/441; 510/477; 510/507; 510/509; 510/511; 264/117; 264/140; 8/137

(58) Field of Search ..... 510/444, 351, 510/356, 357, 361, 441, 477, 507, 509, 511; 264/117, 140; 8/137

(56) References Cited

U.S. PATENT DOCUMENTS

| | | | | | |
|---|---|---|---|---|---|
| 4,585,642 | A | * | 4/1986 | Rieck | 423/333 |
| 5,427,711 | A | * | 6/1995 | Sakaguchi et al. | 510/511 |
| 5,540,855 | A | * | 7/1996 | Baillely et al. | 510/276 |
| 5,618,783 | A | * | 4/1997 | Sakaguchi et al. | 510/507 |
| 5,705,466 | A | * | 1/1998 | Baillely et al. | 510/312 |
| 5,705,473 | A | * | 1/1998 | Kuroda et al. | 510/441 |
| 5,736,501 | A | * | 4/1998 | Yamashita et al. | 510/444 |
| 5,814,289 | A | * | 9/1998 | Tapper et al. | 423/328.2 |

FOREIGN PATENT DOCUMENTS

| | | | |
|---|---|---|---|
| JP | 6502445 | A | 3/1994 |
| WO | WO9207932 | A1 | 5/1992 |

* cited by examiner

*Primary Examiner*—Lorna M. Douyon
(74) *Attorney, Agent, or Firm*—Birch, Stewart, Kolasch & Birch, LLP

(57) ABSTRACT

Detergent formulations incorporating crystalline alkali metal silicate granules provide enhanced performance in removing sebum dirt stains at low dosages of detergent in the wash. The detergent formulations are prepared by combining an alkali metal silicate having a high pH value with a nonionic surfactant and an acid precursor of an anionic surfactant capable of having a lamellar orientation. The formulation is granulated by tumbling in an agitating mixer while increasing the bulk density at elevated temperatures to yield alkali metal silicate granules having a bulk density of from 0.6 to 1.2 g/ml.

44 Claims, 1 Drawing Sheet

METHOD FOR PRODUCING CRYSTALLINE ALKALI METAL SILICATE GRANULES AND GRANULAR HIGH DENSITY DETERGENT

This application is the national phase under 35 U.S.C. §371 of prior PCT International Application No. PCT/JP96/03210 which has an International filing date of Oct. 31, 1996 which designated the United States of America, the entire contents of which are hereby incorporated by reference.

TECHNICAL FIELD

The present invention relates to a method for producing crystalline alkali metal silicate granules. More specifically, the present invention relates to a method for producing crystalline alkali metal silicate granules, which can be stably formulated in other detergents without deteriorating the properties of the crystalline alkali metal silicate, and further have extremely high detergent activity. Also, the present invention relates to a granular detergent composition having a high bulk density and a washing method. More specifically, the present invention relates to a granular detergent composition having a high bulk density which has excellent powder properties and is capable of having excellent detergency with a small standard amount of dosage thereof, and a washing method using the above granular detergent composition.

BACKGROUND ART

A method of granulating crystalline silicates, such as crystalline alkali metal silicates, is disclosed in Japanese Patent Laid-Open No. 3-164422. Here, the method for preparing granules having a high bulk density of from 700 to 1000 g/liter comprises powdering crystalline sodium silicate to a size of from 2 to 400 $\mu$m using a mechanical disintegrator, pressing the powdered silicate with a roller compactor (20 to 40 kN/1 cm width) to give dense materials, comminuting by forcing the silicates through screens, and sieving the comminuted materials. However, it would be impossible to prevent the deterioration of the performance owing to its hygroscopic property, which is an inherent property of the crystalline alkali metal silicates, or to suppress the caking phenomenon caused by consolidation of the crystalline alkali metal silicate owing to their hygroscopic properties. Also, the breaking of the granules during conveying is likely to take place.

Japanese Patent Unexamined Publication No. 6-502445 discloses a method for producing a free-flowable aggregate by blending in an energy-intensive mixer an aluminosilicate or a layered silicate with a particular binder. However, the binder which contains water is undesirable for maintaining excellent performance of the crystalline silicates. Also, the aqueous polymer is needed to be added in an amount of 10 parts or more, but this ingredient gives substantially no contribution to the detergency performance, thereby making it disadvantageous for the purpose of concentrating the composition.

Also, Japanese Patent Laid-Open No. 5-209200 discloses a method for producing a nonionic surfactant-containing granulated product, comprising the steps of agitating and blending a mixture of detergent starting materials containing a nonionic surfactant as a main surfactant component in an agitating mixer, the agitating mixer containing an agitating shaft along the center line of the inner portion, agitation impellers arranged along the agitating shaft, and a clearance formed upon rotating the agitating impellers between the agitating impellers and a wall of the agitating mixer, to thereby form a layer of the detergent starting materials adhered to the wall of the agitating mixer; and granulating the obtained mixture while increasing the bulk density of the detergent starting materials by the agitating impellers. However, since the nonionic surfactant is supported by the capillary force or the surface adsorption of the powdery starting materials, the supporting force is weak. Therefore, although the resulting granulated product has no problems at a practical level, sufficient adhesion of the nonionic surfactant-containing powder to the equipment upon conveying or sufficient exudation inhibition cannot be achieved, as compared to that of the present invention when packing the powder in a carton package.

Moreover, to date, various kinds of chelating agents, ion exchange materials, alkalizers, and dispersants have been known to be used for builders to be blended in detergents. Particularly, the phosphorus-based chelating agents such as tripolyphosphates as a main component thereof have good water solubility and detergency, so that they have been formulated as main detergent builder components.

In recent years, however, the use of tripolyphosphates has decreased, since they can cause eutrophication in closed freshwater areas such as lakes and marshes. Instead, crystalline aluminosilicates (zeolites) have been commonly used as substitutes for the metal ion capturing agent. Many patent applications have been filed concerning the formulation of crystalline aluminosilicates in detergents, as typically disclosed in Japanese Patent Laid-Open No. 50-12381. In addition, Yushi (Vol, 32, No.1, pp.36–40 (January 1979)) discloses the substitution to zeolites which took place at that time.

The rapid progress has taken place in changes in use of phosphorus-free detergents by substituting with zeolites, but the formulation of zeolites is merely a substitution of phosphorus-containing builders, which are used to produce detergents with a low bulk density of 0.2 to 0.4 g/cm$^3$. Such detergents would require a standard amount of dosage of 40 g and 100 to 200 cm$^3$ per one washing cycle, the washing cycle being most commonly using about 30 L of the washing liquid per one cycle in Japan. Therefore, in the case where detergents for about 60 to about 100 washing cycles are placed in a carton package, the resulting detergent package becomes undesirably heavy as from 2.5 to 4.5 kg and undesirably bulky as from 6000 to 20000 ml. Therefore, much inconveniences were caused in burdening the conveying costs in the plant and carrying inconveniences and storage space for the consumers.

Therefore, an intense investigation has been made to produce compact detergents. For instance, Japanese Patent Laid-Open Nos. 62-167396, 62-167399, and 62-253699 disclose a remarkable decrease in the amount of crystalline inorganic salts such as sodium sulfate used as powdering aids conventionally contained in detergents. In addition, Japanese Patent Laid-Open Nos. 61-69897, 61-69899, 61-69900, and 5-209200 disclose that an increase in the bulk density of the detergents leads to a production of detergents having a bulk density of from 0.60 to 1.00 g/ml, whose standard amount of dosage is from 25 to 30 g/30 L, thereby resulting in making the detergents compact to a level of a standard volumetric amount of dosage of from 25 to 50 ml/30 L.

However, in conventional detergents, a large amount of surfactants had to be blended in the detergent compositions because mainstream of the technical idea was to make the oily components in dirt soluble by surfactants. Specifically, sebum dirt stains ascribed to human bodies, the most typical dirt stains adhered to clothes (most likely to be observed on collars and sleeves), are taken as examples. The sebum dirt stains contains oily components, such as free fatty acids and glycerides, with a high content of 70% or more (Ichiro KASHIWA et al., "Yukagaku," 19, 1095 (1969)). The oily components lock carbon and dirt in dust and peeled keratin, so that the resulting substance is observed as dirt stains. In order to wash off the sebum dirt stains, conventional detergents are designed based on a washing mechanism mainly by making these oily components soluble with micelle of surfactants, thereby detaching carbon, dirt, and keratin from clothes. This technical idea has been widely established among those of ordinary skill in the art, and even when the conventional detergents are shifted to compact detergents, substantially no changes took place in the surfactant concentration in the washing liquid. This fact is described in "Dictionary for Detergents and Washing," Haruhiko OKUYAMA et al., p. 428, 1990, First Edition, Asakura Publishing Company Limited, which shows that there are substantially no changes in concentrations in the washing liquid for components other than sodium sulfate.

Based on these washing principles, the surfactant concentration in the washing liquid has to be made high in order to achieve high washing power, so that a large amount of surfactants has to be blended in the detergent composition. Therefore, a drastic reduction in the standard amount of dosage of the detergents was actually difficult. In addition, the presently known production method substantially enables to increase the bulk density to a level of about at most 1.00 g/ml. Therefore, a further reduction in the standard volumetric amount was deemed to be a technically extremely difficult problem.

On the other hand, crystalline alkali metal silicates having particular structure disclosed in Japanese Patent Laid-Open Nos. 5-184946 and 60-227895 shows not only good ion exchange capacity and alkalizing action (alkalizing ability). Therefore, possibility of more compact detergents has been studied because both of the functions which conventionally was satisfied by two different components, such as metal ion capturing agents, such as zeolites, and alkalizers, such as sodium carbonate, can be satisfied with the above crystalline alkali metal silicates alone.

For instance, Japanese Patent Laid-Open No. 6-116588 is concerned with a detergent composition containing a crystalline silicate. In Examples of this publication disclosing a more compact detergent, even in a case where the amount of the detergent composition at washing is reduced by 25%, the detergent composition has a washing power substantially the same as conventional detergent compositions. However, since the composition is formulated based on the conventional washing principle, the surfactant concentration is high, and the alkalizing ability and the ion exchange capacity are ascribed solely to the crystalline silicates contained therein. In this case, the functions of the crystalline silicates as alkalis precede their functions as metal ion capturing agents, so that the washing power of the detergent composition is not always satisfactory. Therefore, if the amount of dosage of the detergent composition were reduced, a good washing power is not able to be maintained.

A number of patent applications have been filed concerning the crystalline silicates disclosed in Japanese Patent Laid-Open No. 60-227895. Japanese Patent Unexamined Publication No. 6-502199 discloses a detergent comprising a layered crystalline silicate, a zeolite, and a polycarboxylate in particular proportions, to thereby provide a detergent which is free from providing film layer formation on fibers and has excellent washing power and bleaching agent stability. However, under the blending conditions given in this publication, when the amount of the detergents added was reduced at washing, the alkalizing ability is not sufficient because the amount of silicate in the builder composition is small, thereby making it impossible to maintain good washing power. Also, this publication never teaches the technical idea that an excellent washing power is exhibited with small detergent dosages.

The technical idea that an excellent washing power is exhibited using a small amount of detergents, as in the present invention, cannot be found for detergents containing crystalline silicates disclosed in Japanese Unexamined Patent Publication 6-500141, Japanese Patent Laid-Open Nos 2-178398 and 2-178399. Rather, in the case where the amounts of the detergent compositions shown in each of Examples are reduced, the washing power is lowered.

Accordingly, an object of the present invention is to provide crystalline alkali metal silicate granules having a high bulk density, good powder flowability and non-caking ability and free from exudation property.

Another object of the present invention is to provide a granular detergent composition having the same level or higher detergency with a notably smaller standard amount of dosage, and a washing method using such a granular detergent composition.

These and other objects of the present invention will be apparent from the following description.

DISCLOSURE OF THE INVENTION

As a result of intense research in view of the above objects, the present inventors have found that in a system substantially containing no water, crystalline alkali metal silicate granules having extremely high detergent activity may be produced by blending a crystalline alkali metal silicate with an acid precursor of an anionic surfactant capable of having lamellar orientation and a nonionic surfactant, and neutralizing the acid precursor, thereby forming a gelation product containing a nonionic surfactant; and granulating by tumbling a mixture of detergent starting materials while increasing bulk density in an agitating mixer using the gelation product as a binder. In addition, the present inventors have found that by adding a water-soluble nonionic organic compound having a melting point of 45° C. or higher and a weight-average molecular weight of 1000 or higher to obtain a starting material mixture of a detergent in the blending step, the exudation property of the nonionic surfactant even in a long-term storage can be suppressed, and good non-blocking property and non-caking ability can be achieved in the resulting crystalline alkali metal silicate granules.

Further, the present inventors have developed a detergent showing excellent detergency with a small standard amount of dosage and good powder properties by blending a nonionic surfactant, an anionic surfactant capable of having a lamellar orientation, a particular crystalline alkali metal silicate, and a metal ion capturing agent in particular proportions.

Specifically, while studying the washing liquid capable of showing good detergency, the present inventors have found that the higher the pH and the lower the water hardness, the dependency of the detergency on the surfactant concentration is lessened, so that good detergency can be achieved. Also, in the case of a high pH but a high water hardness, the detergency is drastically lowered even at a high pH. In the case of washing solely with a composition containing a surfactant but containing no alkalizers, although the detergency at low water hardness is low, the dependency of the detergency on the water hardness is sufficiently small when compared to systems containing alkalizers. From these results, the present inventors have paid attention to the relationship between the washing liquid and the dirt stains.

As discussed in the Background Art section of the present invention, the sebum dirt stains which are the most typical dirt stains adhered to clothes contain free fatty acids and glycerides, and the dirt stains are presumably a mixture of these organic materials with carbon, dirt, or peeled keratin. In the case of a high pH, while the content of the fatty acids increases by hydrolysis of glycerides, the reaction of the fatty acids with alkali metals to form salts also proceeds. The alkali metal salts of the fatty acids are soaps, so that the freeing speed of the dirt stains in the washing liquid becomes notably faster. However, this reaction is a competitive reaction with calcium ions, magnesium ions, etc. in the hard water. Since the alkali metal salts of fatty acids form a scum by carrying out ion-exchange reaction with calcium and magnesium, the dirt stains are solidified without being freed from the interface of clothes in the case where the water hardness is high. For the reasons given above, in the case where the pH is high and the water hardness is low, the washing liquids show excellent detergency, and in the case where the pH is high and the water hardness is high, the washing liquids show notably lowered detergency. Also, in the case where an alkalizer is not formulated, the dependency of the detergency on the water hardness become comparatively lower than the systems containing alkalizers, owing to the fact that the sebum dirt stains are washed only with washing power ascribed to the surfactants.

From these observations, the present inventors have found that one of the reasons for obtaining a detergency at a level equivalent or higher than that obtainable in the conventional detergents even while having a notably lower surfactant concentration value than the conventional detergents is the fact that the soaps formed by the saponification of the glycerides in the dirt stains under the conditions of a low water hardness and a high pH significantly act to give good detergency. In addition, the detergent composition has an excellent detergency at a level equal to or higher than that of the conventional detergents, even when the standard amount of dosage thereof is small and the surfactant concentration in the washing liquid is low, by formulating a surfactant mixture comprising a nonionic surfactant mainly comprising a polyoxyethylene alkyl ethers, which is a surfactant with a low critical micelle concentration (c. m. c.), and an anionic surfactant; a crystalline alkali metal silicate having a high alkaline buffering ability; and a metal ion capturing agent showing a low water hardness in particular proportions. The present invention has been completed based upon these findings.

In one aspect, the present invention is concerned with a method for producing crystalline alkali metal silicate granules, comprising the following steps:

(1) preparing a mixture comprising:

(a) a crystalline alkali metal silicate containing at least $SiO_2$ and $M_2O$, wherein M stands for an alkali metal atom, and an $SiO_2/M_2O$ molar ratio is from 1.5 to 2.6, wherein a maximum pH value exceeds 11.0 at 20° C. in a 0.1% by weight dispersion of the crystalline alkali metal silicate and wherein the crystalline alkali metal silicate has an ion exchange capacity of 100 $CaCO_3$ mg/g or more;

(b) a nonionic surfactant; and (c) an acid precursor of an anionic surfactant capable of having a lamellar orientation; and (2) granulating by tumbling the mixture obtained in step (1) with an agitating mixer while increasing a bulk density at a temperature sufficiently high enough to neutralize said acid precursor, to thereby give crystalline alkali metal silicate granules having a bulk density of from 0.6 to 1.2 g/ml.

In a preferred embodiment, the mixture is prepared by further adding (d) other ingredients in step (1).

In this method, the mixture is prepared in step (1) by adding component (c) to the agitating mixer in any one of the following embodiments:

(i) Embodiment where component (c) is added to the agitating mixer together with component (b);

(ii) Embodiment where component (c) is added to the agitating mixer together with component (a) and component (b); or (iii)Embodiment where component (c) is added to the agitating mixer after component (b) is added to the agitating mixer.

In another embodiment, the mixture is prepared in step (1) by further adding (e) a water-soluble nonionic organic compound having a weight-average molecular weight of 1000 or more and a melting point of 45° C. or higher.

In another aspect, the present invention is concerned with a granular detergent composition for clothes washing having high bulk density, comprising the following components:

(I) surfactant components at least comprising:

A) an polyoxyethylene alkyl ether; and

B) an anionic surfactant capable of having a lamellar orientation, wherein a total amount of component A and component B is 80% by weight or more of the entire surfactant components, and wherein the weight ratio of component A to component B is A/B=20/1 to 1/1;

(II) C) alkali silicate components comprising crystalline alkali metal silicate having an $SiO_2/M_2O$ molar ratio of 1.5 to 2.6, wherein M stands for an alkali metal atom; and (III) D) metal ion capturing agents other than component C having a calcium ion capturing ability of 200 $CaCO_3$ mg/g or more, wherein component I, component II, and component III are present within one granule, and wherein a total amount of component I, component II, and component III is from 70 to 100% by weight of the entire granular detergent composition, wherein the weight ratio of component II to component I is II/I=9/1 to 9/11, and wherein the weight ratio of component II to component III is II/III=4/1 to 1/15, the granular detergent composition having a bulk density being from 0.6 to 1.2 g/ml.

In a preferred embodiment, granule surfaces are coated with amorphous sodium aluminosilicate.

Also, in another preferred embodiment, the granular detergent composition is obtainable by the method for producing crystalline alkali metal silicate described above.

In still another aspect, the present invention is concerned with a washing method comprising the step of washing clothes using the above granular detergent composition for clothes washing having high bulk density, at a surfactant concentration in a washing liquid of from 0.07 to 0.17 g/L.

BRIEF DESCRIPTION OF THE DRAWINGS

The present invention will become more fully understood from the detailed description given below and the accompanying drawings which are given by way of illustration only, and thus, do not limit the present invention, and wherein.

BEST MODE FOR CARRYING OUT THE INVENTION

Figure 1:
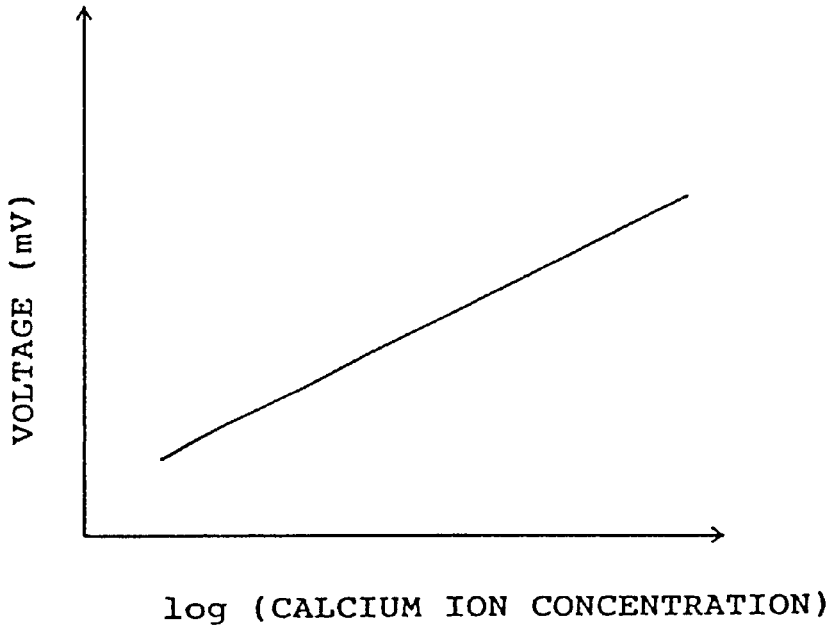
FIG. 1 is a graph showing a calibration curve of the relationship between the logarithm of the calcium ion concentration and the voltage.

The present invention will be explained in detail below.

1. Production Method of the Present Invention

Step (1)

Step (1) comprises preparing a mixture at least comprising:

(a) a crystalline alkali metal silicate containing at least $SiO_2$ and $M_2O$, wherein M stands for an alkali metal atom, and an $SiO_2/M_2O$ molar ratio is from 1.5 to 2.6, wherein a maximum pH value exceeds 11.0 at 20° C. in a 0.1% by weight dispersion of the crystalline alkali metal silicate and wherein the crystalline alkali metal silicate has an ion exchange capacity of 100 $CaCO_3$ mg/g or more;

(b) a nonionic surfactant; and (c) an acid precursor of an anionic surfactant capable of having a lamellar orientation.

The crystalline alkali metal silicate constituting component (a) contains at least $SiO_2$ and $M_2O$, wherein the $SiO_2/M_2O$ molar ratio is from 1.5 to 2.6. From the aspect of anti-solubility in water, the molar ratio is preferably 1.5 or more, and from the aspect of alkalizing ability, the molar ratio is preferably 2.6 or less.

Component (a) above is required to have an excellent alkalizing ability, to a level wherein its maximum pH value exceeds 11.0 at 20° C. in a 0.1% by weight dispersion. In addition, component (a) above particularly has an excellent alkaline buffering effects, remarkably superior alkali buffering effects when compared to those of sodium carbonate and potassium carbonate. Moreover, component (a) above usually has an ion exchange capacity of 100 $CaCO_3$ mg/g or more, preferably from 200 to 600 $CaCO_3$ mg/g. Therefore, component (a) is one of components having ion capturing ability in the present invention.

The average particle size of the crystalline alkali metal silicate constituting component (a) is not particularly limited, and the crystalline alkali metal silicate preferably has an average particle size of from 0.1 to 100 $\mu$m, more preferably from 1 to 70 $\mu$m, further preferably from 5 to 40 $\mu$m. From the aspect of quality control, the average particle size is preferably 0.1 $\mu$m or more, and from the aspect of having high ion exchange speed, the average particle size is preferably 100 $\mu$m or less. Smaller average particle size results in larger specific area, which in turn increase the hygroscopic property and $CO_2$-absorbing ability, thereby resulting in a drastic deterioration of the quality of the resulting product. Moreover, as the ion exchange speed becomes slower, the detergency is liable to be lowered. An average particle size is a median of the particle size distribution.

The crystalline alkali metal silicate having the average particle size and the particle size distribution described above is prepared by pulverizing using pulverizing devices, such as vibration mills, hammer mills, ball-mills, and roller mills. For instance, the crystalline alkali metal silicate can be easily prepared by pulverizing with a vibration mill ("HB-O Type," manufactured by Chuo Kakoki Co. Ltd.).

In the present invention, as for the crystalline alkali metal silicate constituting component (a), one kind may be singly used, or two or more kinds may be used in combination.

Among the crystalline alkali metal silicates constituting component (a), a preference is given to those exemplified as having the following compositions (1) and (2) given below.

$$xM_2O.ySiO_2.zMe_mO_n.wH_2O, \quad (1)$$

wherein M stands for an alkali metal atom; Me stands for one or more elements selected from the group consisting of Group IIa, IIb, IIIa, IVa, and VIII; x, y, z, and w stand for molar numbers for each component, wherein y/x is from 1.5 to 2.6; z/x is from 0.01 to 1.0; n/m is from 0.5 to 2.0; and w is from 0 to 20; and $$M_2O.x'SiO_2.y'H_2O, \quad (2)$$

wherein M stands for an alkali metal atom; x' and y' stand for molar number of each component, wherein x' is from 1.5 to 2.6; and y' is from 0 to 20.

First, the crystalline alkali metal silicates having the general formula (1) above will be detailed below.

In the general formula (1), M stands for an alkali metal atom, wherein the alkali metal elements may be exemplified by Na, K, etc. The alkali metal elements may be used alone, or in combination of two or more kinds. For instance, such compounds as $Na_2O$ and $K_2O$ may be mixed to constitute an $M_2O$ component.

Me stands for one or more elements selected from the group consisting of Group IIa, IIb, IIIa, IVa, and VIII of the Periodic Table, and examples thereof include Mg, Ca, Zn, Y, Ti, Zr, and Fe, which are not particularly limited to the above examples. Here, a preference is given to Mg and Ca from the viewpoint of resource stock and safety. In addition, these elements may be used alone, or in combination of two or more kinds. For instance, such compounds as MgO and CaO may be mixed to constitute an $Me_mO_n$ component.

In addition, the crystalline alkali metal silicates having the general formula (1) may be in the form of hydrates, wherein the amount of hydration (w) is usually in the range of from 0 to 20 moles of $H_2O$.

With respect to the general formula (1), y/x is preferably from 1.5 to 2.6, more preferably from 1.5 to 2.2. From the aspect of anti-solubility in water, y/x is preferably 1.5 or more, and from the aspect of alkalizing ability, y/x is preferably 2.6 or less. When the anti-solubility in water is insufficient, the obtained crystalline alkali metal silicate granules have drastically poor powder properties, such as caking ability, solubility, etc. When the alkalizing ability is lowered, it is insufficient to be used as an alkalizer, and it also has a low ion exchange capacity, thereby making it insufficient to be used as an ion exchange material.

With respect to z/x, it is preferably from 0.01 to 1.0, more preferably from 0.02 to 0.9. From the aspect of the anti-solubility in water, z/x is preferably 0.01 or more, and from the aspect of the ion exchange capacity, z/x is preferably 1.0 or less.

With respect to x, y and z, there are no limitations, as long as y/x and z/x have the above relationships. When $xM_2O$, for example, is $x'Na_2O.x''K_2O$ as described above, x equals to x'+x". The same can be said for z when $zMe_mO_n$ comprises two or more components. Further, "n/m is from 0.5 to 2.0" indicates the number of oxygen ions coordinated to the above elements, which actually takes values selected from 0.5, 1.0, 1.5, and 2.0.

The crystalline alkali metal silicate having the general formula (1) comprises three components, $M_2O$, $SiO_2$, and $Me_mO_n$. Materials which can be converted to each of these components may be used as starting materials for producing the crystalline alkali metal silicate in the present invention.

In the present invention, known compounds can be suitably used for starting materials without limitations. Examples of the $M_2O$ component and the $Me_mO_n$ component include simple or complex oxides, hydroxides and salts of respective elements; and minerals containing respective elements. Specifically, examples of the starting materials for the $M_2O$ component include NaOH, KOH, $Na_2CO_3$, $K_2CO_3$, and $Na_2SO_4$. Examples of the starting materials for the $Me_mO_n$ component include $CaCO_3$, $MgCO_3$, $Ca(OH)_2$, $Mg(OH)_2$, MgO, $ZrO_2$, and dolomite. Examples of the starting materials for the $SiO_2$ component include silica sand, kaolin, talc, fused silica, and sodium silicate.

The method of producing the crystalline alkali metal silicate having the general formula (1) may be exemplified by blending these starting material components to provide a desired composition in x, y, and z for the crystalline alkali metal silicate, and baking the resulting mixture at a temperature in the range of usually from 300 to 1500° C., preferably from 500 to 1000° C., more preferably from 600 to 900° C., to form crystals. In this case, when the heating temperature is less than 300° C., the crystallization is insufficient, thereby making the anti-solubility in water of the resulting crystalline alkali metal silicate poor, and when the heating temperature exceeds 1500° C., coarse grains are likely to be formed, thereby decreasing the ion exchange capacity of the resulting crystalline alkali metal silicate. The heating time is usually 0.1 to 24 hours. Such baking can usually be carried out in a heating furnace such as an electric furnace or a gas furnace.

Next, the crystalline alkali metal silicates having the general formula (2) above will be detailed below.

In the general formula (2), M stands for an alkali metal atom, including Na and K. The elements may be used alone, or in combination of two or more kinds. For instance, such compounds as $Na_2O$ and $K_2O$ may be mixed to constitute an $M_2O$ component. In addition, the crystalline alkali metal silicates having the general formula (2) may be in the form of hydrates, wherein the amount of hydration (y') is usually in the range of from 0 to 20 moles of $H_2O$.

x' is preferably from 1.5 to 2.6, more preferably from 1.5 to 2.2. From the aspect of anti-solubility in water, x' is preferably 1.5 or more, and from the aspect of alkalizing ability, x' is preferably 2.6 or less.

The crystalline alkali metal silicates having the general formula (2) may be produced by the method disclosed in Japanese Patent Laid-Open No. 60-227895. However, the crystalline silicates can be generally produced by baking glassy amorphous sodium silicates at a temperature of from 200 to 1000° C. to form crystals. Details of the production method is disclosed in "Phys. Chem. Glasses, 7, pp.127–138 (1966), Z. Kristallogr., 129, pp.396–404(1969)." Also, the crystalline alkali metal silicates are commercially available in powdery or granular forms under a trade name "Na-SKS-6" ($\delta$-$Na_2Si_2O_5$) (manufactured by Hoechst).

Here, values for the ion exchange capacity of the crystalline alkali metal silicate constituting component (a) are obtained by the method given below.

A 0.1 g sample is accurately weighed and added to 100 ml of a calcium chloride aqueous solution (500 ppm concentration, when calculated as $CaCO_3$), followed by stirring at 25° C. for 60 minutes, after which the mixture is filtered using $Me_m$brane Filter (made of nitrocellulose; manufactured by Advantech) with 0.2 $\mu$m pore size. 10 ml of the filtrate is assayed for Ca content by an EDTA titration, and the calcium ion exchange capacity (cationic exchange capacity) of the sample is calculated from the titer.

The nonionic surfactants constituting component (b) are not particularly limited, and any of known ones usually used in the art may be used. Among them, a preference is given to those in a liquid or pasty state at 40° C. and having an HLB in the range of 9.0 to 16.0 because of their excellent dirt-removing, foaming and foam breaking effects. HLB used herein is defined in the following literature: W. C. Griffin, *Kirk-Othmer Encyclopedia of Chemical Technology* 3rd ed. (M. Grayson ed.) vol 8, Weily Interscience, New York 1979 pp.900–930.

Specifically, the following nonionic surfactants may be used as the main nonionic surfactants: Polyoxyethylene alkyl ethers, which are ethylene oxide adducts of linear or branched, primary or secondary alcohols, whose alkyl moieties have from 10 to 20 carbon atoms, preferably from 10 to 15 carbon atoms, more preferably from 12 to 14 carbon atoms, each of the ethylene oxide adducts having an average molar amount of from 5 to 15, preferably from 6 to 12, more preferably from 6 to 10. In addition, the above polyoxyethylene alkyl ethers generally contain a large amount of polyoxyethylene alkyl ethers which are ethylene oxide adducts having low molar numbers, with a preference given to the ethylene oxide adducts having a 0 to 3 molar number in an amount of from 35% by weight or less, particularly 25% by weight or less. Aside from the above, polyoxyethylene alkylphenyl ethers, polyoxyethylene sorbitan fatty acid esters, polyoxyethylene sorbitol fatty acid esters, polyoxyethylene fatty acid esters, polyoxyethylene alkyl ether carboxylate alkyl esters, polyoxyethylene polyoxypropylene alkyl ethers, polyoxyethylene castor oils, polyoxyethylene cured castor oils, polyoxyethylene alkylamines, glycerol fatty acid esters, higher fatty acid alkanolamides, alkyl glycosides, alkyl glucosamides, and alkylamine oxides.

Examples of the acid precursors of anionic surfactants capable of having a lamellar orientation constituting component (c) include those having the properties given in (i) or (ii):

(i) An acid precursor of an anionic surfactant, wherein a mixture obtained as follows observed by a polarized microscope shows an anisotropic property, the mixture prepared by blending the acid precursor of an anionic surfactant with a nonionic surfactant, and neutralizing the above components with sodium carbonate.

The method of confirming the anisotropic property is as follows. Eighty parts by weight of a nonionic surfactant, 20 parts by weight of an acid precursor of an anionic surfactant used for confirming an anisotropic property, a sodium carbonate powder (average particle size: about 5 $\mu$m) in a sufficient amount for neutralizing the acid precursor are thoroughly blended by a high-speed shear mixer (homogenizer) at a temperature equal to or higher than the melting point of the above acid precursor, to thereby neutralize the components. After a sample taken from the above mixture is heated to the melting point of the acid precursor, the sample is cooled to 40° C. While keeping the temperature at 40° C., an observation is made by using a polarized microscope ("OPTIPHOT-POL," manufactured by Nikon Corporation).

(ii) An acid precursor of an anionic surfactant, wherein a mixture obtained as follows analyzed by an X-ray diffraction method shows a lamellar oriented peaks, the mixture prepared by blending an acid precursor of an anionic surfactant with a nonionic surfactant, and neutralizing the above components with sodium carbonate.

The X-ray diffraction method is carried out as follows. A sample comprising a nonionic surfactant and an acid precursor of an anionic surfactant in a weight ratio of from 80/20 to 20/80 is prepared. The sample is subject to a measurement using a Rigaku RAD System (X-ray source: Cu (K$\alpha$; $\lambda$=1.5405); measurement range: 2$\theta$=2° to 30°).

Although the acid precursors of anionic surfactants capable of having a lamellar orientation constituting component (c) are not particularly limited, examples thereof include saturated or unsaturated fatty acids having 10 to 22 carbon atoms, preferably saturated or unsaturated fatty acids having 12 to 18 carbon atoms; alkylsulfuric acids having 10 to 22 carbon atoms, preferably alkylsulfuric acids having 12 to 14 carbon atoms; α-sulfonated fatty acids having 10 to 22 carbon atoms, preferably α-sulfonated fatty acids having 14 to 16 carbon atoms; and polyoxyethylene alkyl ether sulfuric acids whose alkyl moieties have 10 to 22 carbon atoms and whose ethylene oxide moieties have an average additional molar number of from 0.2 to 20, preferably polyoxyethylene alkyl ether sulfuric acids whose alkyl moieties have 12 to 14 carbon atoms and whose ethylene oxide moieties have an average additional molar number of from 0.5 to 1.5. As for the number of carbon atoms in the above compounds, from the viewpoint of detergency power and odor, a preference is given to those compounds having 10 carbon atoms or more, and from the viewpoints of detergency power and solubility, a preference is given to those compounds having 22 or less carbon atoms.

The acid precursors usable in the present invention are preferably fatty acids. Specifically, the acid precursors may be one or more compounds selected from the group consisting of saturated fatty acids, such as capric acid, lauric acid, myristic acid, palmitic acid, and stearic acid; and unsaturated fatty acids, such as oleic acid. Particularly, a preference is given to saturated fatty acids, such as myristic acid (for instance, "LUNAC MY-98," manufactured by Kao Corporation) and palmitic acid (for instance, "LUNAC P-95," manufactured by Kao Corporation).

In step (1) of the present invention, (d) other ingredients may be further added. Examples of other ingredients constituting component (d) include one or more kinds selected from the group consisting of powdery builders, porous oil-absorbing carriers, redeposition agents, enzymes, and fluorescents.

The powdery builders may be any organic or inorganic builders generally used in detergents in powdery form without particular limitation. In addition, these organic or inorganic builders may be used in the form of hydrates by mixing an organic or inorganic builder capable of being hydrated with water. Examples of the powdery builders include one or more compounds selected from the group consisting of phosphates, carbonates, sodium sulfate, sodium chloride, bicarbonates, sulfites, silicates, crystalline aluminosilicates, amorphous aluminosilicates, citrates, polyacrylates, salts of copolymers of acrylic acid-maleic acid, and polyglyoxylates.

These powdery builders preferably have an average particle size of 500 μm or less, more preferably 350 μm or less.

In addition, spray-dried particles which are obtainable by spray-drying by a known method an aqueous slurry containing one or more builders (hereinafter simply "spray-dried particles") may be used as powdery builders. By using the spray-dried particles, (1) the bulk density of the overall detergent may be controlled, and (2) oil-absorbing amount of the builders can be improved. Spray-drying may be carried out by any known methods.

Specifically, a preference is given to particles obtainable by spray-drying an aqueous slurry containing one or more compounds selected from the group consisting of tripolyphosphates, carbonates, crystalline aluminosilicates, amorphous aluminosilicates, citrates, sodium sulfate, sulfites, polyacrylates, salts of copolymers of acrylic acid and maleic acid, polyglyoxylates, non-dissociating polymers, such as polyethylene glycols, polyvinyl alcohols, polyvinyl pyrrolidones, carboxymethyl cellulose, and cold water-soluble urethanated polyvinyl alcohols, anionic surfactants, nonionic surfactants, and fluorescent dyes.

Moreover, a particular preference is given to particles obtained by spray-drying a slurry containing one or more compounds selected from the group consisting of carbonates such as sodium carbonate, crystalline aluminosilicates, citrates, sodium sulfate, sulfites such as sodium sulfite, polyacrylates such as sodium polyacrylates, salts of copolymers of acrylic acid and maleic acid, such as sodium salts of copolymers of acrylic acid and maleic acid, polyglyoxylates such as sodium polyglyoxylates, anionic surfactants, nonionic surfactants, and fluorescent dyes. Here, the spray-dried particles preferably have an average particle size of from 100 to 600 μm, particularly of from 150 to 400 μm.

Also, the water content of the water slurry is preferably from 30 to 80% by weight, more preferably from 35 to 60% by weight. In the production of the spray-dried particles, one or more of anionic surfactants, cationic surfactants, and nonionic surfactants may be optionally added in a total amount of 40% by weight or less to the spray-dried particles, and other ingredients may be added in an amount of 5% by weight or less.

The porous oil-absorbing carrier has the following properties:

(R) Having a pH of 8 or higher when prepared as an aqueous solution or a dispersion, at 20° C. with a concentration of 1 g/liter;

(S) Having a microporous capacity measured by a mercury porosimeter of from 100 to 600 $cm^3$/100 g;

(T) Having a specific surface area according to BET method of from 20 to 700 $m^2$/g; and (U) Having an oil-absorbing capacity according to JIS K 5101 of 100 ml/100 g or more, preferably 150 ml/100 g or more, the porous oil-absorbing carrier having an average particle size or an average primary particle size of 10 μm or less. The use of the porous oil-absorbing carrier makes it possible to blend component (b) and component (c) in large amounts. Examples of the porous oil-absorbing carriers include the following:

1) Amorphous Aluminosilicate Salts

Examples of compounds having amorphous aluminosilicate salts as a main component thereof include "ALUMINIUM SILICATE P820," (manufactured by Degussa AG) and "TIXOLEX 25," (manufactured by KOFRAN CHEMICAL Co., Ltd.), and those having the following general formulas can be suitably used.

$$x(M_2O).Al_2O_3.y(SiO_2).w(H_2O),$$

wherein M represents an alkali metal atom, such as a sodium atom or a potassium atom; x, y, and w represent molar numbers of each of the components, which generally fall in the following ranges:

$0.2 \leqq x \leqq 2.0$;

$0.5 \leqq y \leqq 10.0$; and w is an arbitrary number of zero (0) or higher.

$$x(MeO).y(M_2O).Al_2O_3.z(SiO_2).w(H_2O),$$

wherein Me represents an alkaline earth metal atom, such as a calcium atom or a magnesium atom; M represents an alkali metal atom, such as a sodium atom or a potassium atom; x, y, z, and w represent molar numbers of each of the components, which generally fall in the following ranges:

$0.001 \leqq x \leqq 0.1$;

$0.2 \leqq y \leqq 2.0$;

$0.5 \leqq z \leqq 10.0$; and w is an arbitrary number of zero (0) or higher.

These amorphous aluminosilicate salts above have good ion exchange capacity.

2) Calcium Silicates

Examples of sodium silicates include "FLORITE R" (manufactured by Tokuyama Soda Co., Ltd.) and "HUBERSORB™ 600" (manufactured by J.M. Huber Corporation).

Among the above porous oil-absorbing carriers, a preference is given to amorphous aluminosilicates having a water content of from 15 to 30% by weight, because the neutralization reaction with the acid precursor of the anionic surfactants capable of having a lamellar orientation can be favorably progressed. Further, these amorphous aluminosilicates preferably have an average primary particle size of 0.1 μm or less, and agglomerates thereof preferably have an average particle size of 50 μm or less.

In addition, the redeposition agents, enzymes, and fluorescents may be those usually used in detergent without particular limitation.

Incidentally, in the method of the present invention, unless specified otherwise, the average particle size or the average particle size of the primary particles of the materials used is determined by one of the following methods. In the case where the average particle size of the materials is 100 μm or more, each of standard sieves according to JIS Z 8801 is vibrated for 5 minutes, a weight percentage depending upon the size openings of the sieves is calculated. In the case where the average particle size is less than 100 μm, a method utilizing light scattering, for instance, by using "PARTICLE ANALYSER" (manufactured by Horiba, Ltd.) may be used for measuring the average particle size. In addition, the average particle size of the crystalline alkali metal silicate was measured by a laser scattering particle size distribution analyzer ("LA-700," manufactured by HORIBA Ltd.).

The proportions of each of component (a), component (b), and component (c) in step (1) may be preferably as follows. Specifically, it is preferred that the amount of component (a) in the entire mixture is 25% by weight or more; a total amount of component (a), component (b), and component (c) in the entire mixture is from 50 to 100% by weight; the amount of component (c) is from 25 to 100 parts by weight, based on 100 parts by weight of component (b); the weight ratio of a total amount of component (b) and component (c) to component (a), namely [(b)+(c)]/(a), is from 0.1 to 2.0; and the amount of component (d) in the entire mixture is from 0 to 50% by weight. Also, it is greatly preferred that the amount of component (a) in the entire mixture is 30% by weight or more; a total amount of component (a), component (b), and component (c) in the entire mixture is from 60 to 80% by weight; the amount of component (c) is from 40 to 80 parts by weight, based on 100 parts by weight of component (b); the weight ratio of a total amount of component (b) and component (c) to component (a), namely [(b)+(c)]/(a), is from 0.3 to 1.5; and the amount of component (d) in the entire mixture is from 20 to 40% by weight.

In the present invention, it is particularly preferred to lower the water content in the crystalline alkali metal silicate granules. Specifically, the water content in the crystalline alkali metal silicate granules is preferably 5% by weight or less, more preferably 3% by weight or less, further preferably 1% by weight or less. Here, the water content in the crystalline alkali metal silicate granules is measured by the following method. Specifically, a three-gram sample is placed on a weighing dish, and the sample is dried for 2 hours at 105° C. with an electric dryer. The weight of the sample after drying is measured. The water content is determined by the weight loss, namely the difference of the sample before and after drying, and the amount is expressed in percentage. By lowering the water content in the crystalline alkali metal silicate granules, it is possible to notably prevent the deterioration of such properties as solubility, chelating ability, and alkalizing ability of the resulting crystalline alkali metal silicate granules or prevent the caking phenomenon of the resulting granules.

Here, in order to lower the water content in the crystalline alkali metal silicate granules, for instance, starting materials having low water contents may be preferably used. Specifically, starting materials for each of component (a), component (b), and component (c) having a water content of 1% by weight or less may be preferably used. Those having smaller water contents for component (a), component (b), and component (c) are preferred, and more preferred ranges for water contents for each of component (a), component (b), and component (c) are 0.5% by weight or less, still more preferably 0.1% by weight or less. In addition, as for the water content of component (d), it is preferred to have a low water content, as in the cases of component (a), component (b), and component (c). The water content of component (d) may be preferably set so as to have the overall water content of the crystalline alkali metal silicate granules at a level of 5% by weight or less as mentioned above. Incidentally, in the present specification, the water contents of component (a), component (b), component (c) and component (d) are measured as follows. Unless specified otherwise, component (a) and component (d) are measured in the same manner as the water content measurement in the above crystalline alkali metal. silicate granules, and component (b) and component (c) are measured by Karl Fischer technique.

The crystalline alkali metal silicate granules in the present invention do not substantially contain water as described above. Since a gelation product comprising a neutralized product of the acid precursor of anionic surfactants capable of having a lamellar orientation acts as a binder, exudation of the liquid components in the granules and hygroscopic property of the crystalline alkali metal silicate can be notably lowered. Therefore, there would not be any problem in blending the above crystalline alkali metal silicate granules in detergents, etc. Moreover, since the above crystalline alkali metal silicate granules comprises components with significant reduction in ingredients which are not directly involved in washing, such as extending agents, the resulting detergent composition containing the crystalline alkali metal silicate granules is effectively concentrated Further, when the above granules are used as an additive, the degree of freedom of the compositions of the base detergents can be made notably higher.

The blending methods employed in step (1) are not particularly limited, and a preference is given to a case where blending of component (c) with component (a) does not precede blending of component (b) with component (a) from the viewpoint of acceleration of the gelated product formation. Specifically, in order to form the gelated product, it is preferred that the neutralization reaction between component (a) and component (c) is carried out in the presence of component (b). Therefore, when the neutralization reaction between component (a) and component (c) is carried out in the absence of component (b), the formation of the gelated product is undesirably suppressed.

In the case where a mixture comprise component (a) to component (c), or component (a) to component (d) is prepared, and the mixture is prepared by a batch process, various methods exemplified by (A) to (C) below may be employed.

(A) Blending methods comprising the steps of preparing a liquid mixture of component (b) and component (c) in advance, and then blending the liquid mixture with component (a). At this time, the temperature of the mixture may be more preferably equal to or higher than the temperature of fusion of the liquid mixture. More specifically, examples of such blending methods include the following embodiments:

[1] Embodiment comprising supplying component (a) in the mixer in advance; and then adding and blending a liquid mixture of component (b) and component (c) to component (a).

[2] Embodiment comprising simultaneously supplying in the mixer in small amounts at a time of each of component (a) and a liquid mixture of component (b) and component (c).

Among the above embodiment (A) [1] and [2], a preference is given to the blending method (A) [1] from the viewpoint of the acceleration of the gelated product formation.

Incidentally, the blending methods and the mixers employed for the preparation of the liquid mixture of component (b) and component (c) are not particularly limited, and any of generally known blending methods and mixers may be employed. At this time, the liquid mixture may be prepared preferably at a temperature equal to or higher than the melting points of both component (b) and component (c).

(B) Blending methods comprising the steps of blending component (b) and component (a) in advance, and then adding and blending component (c) to the above mixture. At this time, the temperature of the mixture may be equal to or higher than the melting point of component (b), still more preferably equal to or higher than the temperature of the higher one among the melting points of both component (b) and component (c). More specifically, examples of such blending methods include the following embodiments:

[1] Embodiment comprising supplying component (a) in the mixer in advance; adding and blending component (b) with component (a); and then adding and blending component (c) to the above mixture.

[2] Embodiment comprising simultaneously supplying in the mixer in small amounts at a time of each of component (a) and component (b); and then adding and blending component (c) to the above mixture.

(C) Blending methods comprising the steps of adding and blending simultaneously component (b) and component (c) with component (a). At this time, the temperature of the mixture may be equal to or higher than the melting point of component (b), still more preferably equal to or higher than the temperature of the higher one among the melting points of both component (b) and component (c). More specifically, examples of such blending methods include the following embodiments:

[1] Embodiment comprising supplying component (a) in the mixer in advance; and then adding and blending simultaneously component (b) and component (c) to component (a).

[2] Embodiment comprising simultaneously supplying in the mixer in small amounts at a time of each of component (a), component (b), and component (c).

Also, in the case where a mixture comprise component (a) to component (c), or component (a) to component (d) is prepared, and the mixture is prepared by a continuous process, the detergent starting materials are blended, or simultaneously blended and granulated, by a continuous process, and the methods for supplying the detergent starting materials are not particularly limited. For instance, various methods exemplified by following embodiments may be employed.

[1] Embodiment comprising continuously supplying in the mixer individually each of component (a), component (b) and component (c) without mixing in advance.

[2] Embodiment comprising continuously supplying in the mixer component (a) and a liquid mixture of component (b) and component (c).

[3] Embodiment comprising continuously supplying in the mixer a mixture obtainable by mixing component (a) and component (b) in advance, and component (c).

Among the above methods, the embodiment [2] are particularly useful from the viewpoint of the acceleration of the gelated product formation.

Alternatively, in the present invention, in the case where the crystalline alkali metal silicate granules are continuously granulated, in another embodiment, after component (b), component (c), and component (a) are blended together in advance by a batch process, the resulting mixture may be continuously supplied in the granulation process. Also, in cases of both the batch process and the continuous process, the liquid components, namely, (b) component, (c) component, and a liquid mixture of (b) component and (c) component, may be preferably supplied by spraying. Incidentally, in the case where (d) component having alkali property is used, component (d) is preferably handled in the same manner as component (a). Specifically, it is preferred that the blending of component (d) with component (c) does not precede the blending of component (b) with component (c). As for other (d) component without having such alkali properties, embodiments for supplying component (d) in a batch process or a continuous process may not be particularly limited.

Further, (e) water-soluble nonionic organic compound having a weight-average molecular weight of 1000 or more and a melting point of 45° C. or higher may be preferably used in step (1). The water-soluble nonionic organic compounds constituting component (e) may be more preferably those having melting points of from 45 to 100° C. and weight-average molecular weights of from 1000 to 30000. Typical examples of the organic compounds are polyether-based nonionic organic compounds and polyoxyethylene-based nonionic organic compounds, including polyethylene glycols (PEG), polypropylene glycols, polyoxyethylene alkyl ethers, and pluonic-type nonionic surfactants. Among these water-soluble nonionic organic compounds, a greatest preference is given to the PEG from the viewpoint of obtaining even more desired granular properties, such as prevention of exudation property, non-blocking property, and non-caking property, during long-term storage, and the PEG's having weight-average molecular weights of from 3000 to 30000 are preferred, more preferably from 4000 to 15000.

In step (1), the proportions of each of the components in cases where component (e) mentioned above is further added are not particularly limited as long as the desired effects of the present invention can be obtained, and the proportions, for instance, may be desirably as follows.

Specifically, it is preferred that the amount of component (a) in the entire mixture is 25% by weight or more; a total amount of component (a), component (b), component (c), and component (e) in the entire mixture is from 50 to 100% by weight; the amount of component (c) is from 25 to 100 parts by weight, based on 100 parts by weight of component (b); the amount of component (e) is from 2 to 30 parts by weight, based on 100 parts by weight of component (b); the weight ratio of a total amount of component (b), component (c), and component (e) to component (a), namely [(b)+(c)+(e)]/(a), is from 0.1 to 2.0; and the amount of component (d) in the entire mixture is from 0 to 50% by weight.

Also, it is greatly preferred that the amount of component (a) in the entire mixture is 30% by weight or more; a total amount of component (a), component (b), component (c), component (e) in the entire mixture is from 55 to 80% by weight; the amount of component (c) is from 40 to 80 parts by weight, based on 100 parts by weight of component (b); the amount of component (e) is from 5 to 20 parts by weight, based on 100 parts by weight of component b); the weight ratio of a total amount of component (b), component (c), and component (e) to component (a), namely [(b)+(c)+(e)]/(a), is from 0.3 to 1.5; and the amount of component (d) in the entire mixture is from 20 to 45% by weight.

The water content of component (e) may be preferably set so as to lower the overall water content of the crystalline alkali metal silicate granules. Specifically, the water content of component (e) is preferably 1% by weight or less, more preferably 0.5% by weight or less, still more preferably 0.1% by weight or less. Here, the water content of component (e) is measured by Karl Fischer technique.

The blending methods for cases of further adding component (e) employed in step (1) are not particularly limited. When the mixture is prepared by a batch process in the present invention, various methods exemplified by (A) to (C) below may be employed.

(A) Blending methods comprising the steps of preparing a liquid mixture of component (b), component (c), component (e) in advance, and then blending the liquid mixture with component (a). At this time, the temperature of the mixture may be more preferably equal to or higher than the temperature of fusion of the liquid mixture. More specifically, examples of such blending methods include the following embodiments:

[1] Embodiment comprising supplying component (a) in the mixer in advance; and then adding and blending a liquid mixture of component (b), component (c), and component (e) with component (a).

[2] Embodiment comprising simultaneously supplying in the mixer in small amounts at a time of each of component (a) and a liquid mixture of component (b), component (c), and component (e).

Among the above embodiment (A) [1] and [2], a preference is given to the blending method (A) (1) from the viewpoint of the acceleration of the gelated product formation.

(B) Blending methods comprising the steps of preparing a liquid mixture obtainable by blending at random two of the components from component (b), component (c), and component (e), and then blending the liquid mixture with a remaining component and component (a). At this time, the temperature of the mixture may be more preferably equal to or higher than the temperature of the higher one among the temperature of fusion of the liquid mixture and the melting point of the remaining component. More specifically, examples of such blending methods include the following embodiments:

[1] Embodiment comprising supplying component (a) in the mixer in advance; adding and blending a liquid mixture comprising component (b) and component (e); and then adding and blending component (c) to the above mixture.

[2] Embodiment comprising supplying component (a) in the mixer in advance; simultaneously supplying in the mixer in small amounts at a time of each of component (c) and a liquid mixture of component (b) and component (e).

[3] Embodiment comprising supplying component (a) in the mixer in advance; adding and blending component (b) with component (a); and then adding and blending a liquid mixture comprising component (c) and component (e) to the above mixture.

[4] Embodiment comprising supplying component (a) in the mixer in advance; simultaneously supplying in the mixer in small amounts at a time of each of component (b) and a liquid mixture of component (c) and component (e).

[5] Embodiment comprising supplying component (a) in the mixer in advance; adding and blending component (e) with component (a); and then adding and blending a liquid mixture comprising component (b) and component (c) with the above mixture.

[6] Embodiment comprising supplying component (a) in the mixer in advance; simultaneously supplying in the mixer in small amounts at a time of each of component (e) and a liquid mixture of component (b) and component (c).

[7] Embodiment comprising supplying component (a) in the mixer in advance; adding and blending a liquid mixture comprising component (b) and component (c) with component (a); and then adding and blending component (e) with the above mixture.

(C) Blending methods comprising the steps of adding and blending component (b), component (c), and component (e) with component (a) without mixing in advance. At this time, the temperature of the mixture may be more preferably equal to or higher than the highest one among the melting points among component (b), component (c), and component (e). More specifically, examples of such blending methods include the following embodiments:

[1] Embodiment comprising supplying component (a) in the mixer in advance; adding and blending component (b) with component (a); subsequently adding and blending component (e) with the above mixture; and then adding and blending component (c) to the resulting mixture.

[2] Embodiment comprising supplying component (a) in the mixer in advance; adding and blending component (b) with component (a); and then simultaneously supplying in the mixer in small amounts at a time of each of component (c) and component (e).

[3] Embodiment comprising supplying component (a) in the mixer in advance; simultaneously supplying in the mixer in small amounts at a time of each of component (c) and component (e); and then adding and blending component (c) with the resulting mixture.

[4] Embodiment comprising supplying component (a) in the mixer in advance; and then simultaneously supplying in the mixer in small amounts at a time of each of component (b), component (c), and component (e).

[5] Embodiment comprising supplying component (a) in the mixer in advance; simultaneously supplying in the mixer in small amounts at a time of each of component (b) and component (c); and then adding and blending component (e) with the resulting mixture.

Incidentally, the blending methods and the mixers employed for the preparation of the liquid mixture obtainable by blending at random two of the components from component (b), component (c), and component (e), or obtainable by blending component (b), component (c), and component (e) without mixing in advance, are not particularly limited, and any of generally known blending methods and mixers may be employed.

Also, in the case where the mixture is prepared by a continuous process in the present invention, the detergent starting materials are blended or simultaneously blended and granulated by a continuous process, and the methods for supplying the detergent starting materials are not particularly limited. For instance, various methods exemplified by following embodiments may be employed.

[1] Embodiment comprising continuously supplying in the mixer component (a) and a liquid mixture of component (b), component (c), and component (e).

[2] Embodiment comprising continuously supplying in the mixer component (a), component (e), and a liquid mixture of component (b) and component (c).

[3] Embodiment comprising continuously supplying in the mixer component (a), component (c), and a liquid mixture of component (b) and component (e).

[4] Embodiment comprising continuously supplying in the mixer component (a), component (b), and a liquid mixture of component (c) and component (e).

[5] Embodiment comprising continuously supplying in the mixer component (a), component (b), component (c) and component (e) without mixing in advance.

Incidentally, in the case where compounds showing alkalizing ability is used for component (d), it is preferred that the blending of component (d) with component (c) does not precede the blending of component (b) with component (c). In cases where any other compounds without having such alkali properties are used for component (d), embodiments for supplying component (d) in a batch process or a continuous process may not be particularly limited.

The mixture obtained in step (1) is preferably granulated by tumbling the mixture under the temperature conditions given above, and it may be carried out at A temperature sufficiently high enough to neutralize the acid precursor of an anionic surfactant capable of having lamellar orientation. At such temperatures, step (1) proceeds simultaneously with step (2), so that the blending time and the granulation time are shortened, thereby making highly advantageous from the viewpoint of productivity. Therefore, the simultaneous reactions of step (1) and step (2) are within the scope of the present invention.

Examples of devices preferably used for step (1) in the present invention include the following. In the case where the method of the present invention is carried out by a batch process, the devices of (1) to (4) are preferable.

(1) A mixer containing an agitating shaft in the inner portion of a blending vessel and agitating impellers on the agitating shaft, to carry out blending of the components. Specific examples include Henschel Mixer (manufactured by Mitsui Miike Machinery Co., Ltd.); High-Speed Mixer (Fukae Powtec Corp.); and Vertical Granulator (manufactured by Powrex Corp.). A particular preference is given to a mixer containing an agitating shaft arranged along the center line of a horizontal, cylindrical blending vessel and agitating impellers arranged on the agitating shaft, to carry out blending of the components, including Lodige Mixer (manufactured by Matsuzaka Giken Co., Ltd.), and PLOUGH SHARE Mixer (manufactured by PACIFIC MACHINERY & ENGINEERING Co., LTD.).

(2) A mixer comprising a rotatable V-shaped blending vessel, to carry out blending of the components, including, for instance, V-type Mixer (manufactured by Fuji Paudal Co., Ltd.).

(3) A mixer comprising spiral ribbon impeller in a semi-cylindrical, non-rotatable vessel, to carry out blending of the components, including, for instance, Ribbon Mixer (manufactured by Fuji Paudal Co., Ltd.).

(4) A mixer containing a screw having a rotating shaft arranged parallel to the vessel wall, while revolving the screw along a conical vessel, to carry out blending of the components, including, for instance, Nauta Mixer (manufactured by Hosokawa Micron Corp.), and SV Mixer (Shinko Panteck Co., Ltd.).

Examples of devices preferably used for a continuous process include devices (1) to (3) given below.

(1) A continuous mixer comprising a vertical cylinder having a powder supply opening-and a main shaft having a blending blade, the main shaft being supported by an upper bearing and the vertical cylinder having a free discharging side, to carry out blending of the components, including, for instance, Flexo Mix (manufactured by Powrex Corp.).

(2) A continuous mixer comprising a disc plate with agitating pins, to which the starting materials are supplied on the upper portion of the disc plate, the disc plate being rotated at a high speed, to thereby carry out blending of the components with a shear force, including, for instance Flow Jet Mixer (manufactured by Funken Powtechs, Inc.), and Spiral Pin Mixer (manufactured by PACIFIC MACHINERY & ENGINEERING Co., LTD.).

(3) A continuous mixer containing an agitating shaft arranged in the inner portion of the blending vessel and agitating impellers arranged on the shaft, to carry out blending of the components. Specifically, Continuous Henschel Mixer (manufactured by Mitsui Miike Machinery Co., Ltd.) may be used. Further, devices, such as High-Speed Mixer (Fukae Powtec Corp.), and Vertical Granulator (manufactured by Powrex Corp.) may be used as continuous mixing devices. A preference is given to a continuous-type mixer containing an agitating shaft along the center line of a horizontal, cylindrical blending vessel and agitating impellers arranged on the agitating shaft, to carry out blending of the components, including Lodige Mixer (manufactured by Matsuzaka Giken Co., Ltd.), and PLOUGH SHARE Mixer (manufactured by PACIFIC MACHINERY & ENGINEERING Co., LTD.).

Step (2)

Step (2) is a process for preparing a granulated product, namely crystalline alkali metal silicate granules, using a mixture obtained in step (1). Step (2) comprises granulating by tumbling the mixture obtained in step (1) in an agitating mixer while increasing a bulk density at a temperature sufficiently high enough to neutralize the acid precursor, to thereby give the crystalline alkali metal silicate granules having a high bulk density of 0.6 to 1.2 g/ml. In other words, the temperature is set high enough to have both component (b) and component (c) in liquid states, so that component (a) is allowed to react with component (c) at a high efficiency, to give a gelated product.

More specifically, the granulation process in step (2) is preferably carried out by adjusting the temperature to be equal to or higher than the following temperature shown in A) to E):

A) In a case of using a liquid mixture obtainable by blending component (b) and component (c) in step (1), the temperature of fusion of the liquid mixture.

B) In a case of using component (b) and component (c) without mixing in advance in step (1), the higher one among the melting points among component (b) and component (c).

C) In a case of using a liquid mixture obtainable by blending component (b), component (c), and component (e) in step (1), the temperature of fusion of the liquid mixture.

D) In a case of using (i) a liquid mixture, obtainable by blending at random two of the components from component (b), component (c), and component (e), together with (ii) a remaining component in step (1), the temperature of the higher one among the temperature of fusion of the liquid mixture and the melting point of the remaining component.

E) In a case of using component (b), component (c), and component (e) without mixing in advance in step (1), the highest one among the melting points among component (b), component (c) and component (e).

Incidentally, in the present specification, the term "the temperature of fusion" of the liquid mixture refers to the lowest temperature of the temperature at which the entire mixture comprising two or more components is uniformly maintained in a liquid state. The temperature of fusion may differ depending upon the kinds of components constituting the mixture and the blending ratios thereof, and the temperature of fusion in the present invention may be, for instance, preferably 100° C. or less, more preferably 80° C. or less, still more preferably 70° C. or less.

Here, the granulation temperatures given in this step may preferably be equal to or higher than the temperature shown in A) to E) given above from the viewpoint of acceleration of the reaction. However, for practically purposes, a more preferred range is a temperature which is higher than the temperature shown in A) to E) of fusion by 0 to 50° C., still more preferably a temperature which is higher than the temperature shown in A) to E) by 10 to 30° C.

Incidentally, in order to accelerate the progress of the reaction, water may be suitably added in step (1) or (2). Alternatively, an aqueous alkaline solution, such as an aqueous sodium silicate solution, an aqueous sodium hydroxide solution, or an aqueous potassium hydroxide solution, may be added in an amount equal to or less than that equivalent for the neutralization of the acid precursor in step (1) or (2). Here, the water content in the crystalline alkali metal silicate granules is preferably in an amount of 5% by weight or less as described above, so that the amount of water added is preferably at a level so as to give the above-mentioned ranges.

When the reaction takes place, a gelated product carrying component (b) is formed on a surface of component (a), and the formed gelles product serves not only to act as a binder in the granulation process in step (2) but also to improve the supporting force of component (b) on the powder surface of component (a), to thereby presumably inhibiting exudation. Incidentally, although the temperature of the granulation product at completion of step (2) is not particularly limited, the temperature of the granulation product is preferably higher than the temperature shown in A) to E) above by 10° C. or more, more preferably by 20° C. or more. In general, as a matter of course, higher the granulation temperature, more the reaction is accelerated, but it is desired to select a temperature suitable for industrial purposes. When the temperature is in the above given ranges, the gelation reaction can be accelerated, thereby making it possible to advantageously obtain the desired granulated product with a high efficiency.

In the granulation process of step (2) mentioned above, since the agitating mixer is needed to be adjusted to particular temperature settings, the agitating mixer having easily temperature-controllable functions are preferred. A preference is given to, for instance, an agitating mixer equipped with a jacket capable of flowing liquids such as heated water. This is because the temperature of liquids inside the jacket of such mixers can be easily set to be equal to or higher than the temperature shown in A) to E) above. Incidentally, in order to produce the granulated product maintained at a desired temperature at completion of step (2) mentioned above, the jacket temperature is suitably controlled.

In addition, among the mixers, a preference is given an agitating mixer comprising an agitation shaft along a center line of the agitating mixer, and agitation impellers arranged on the agitating shaft, from the viewpoint of highly efficiently forming the gelles products mentioned above used as binders while tumbling and granulating the mixture with the agitating mixer. Examples of the agitating mixers having such constructions include devices, such as Henschel Mixer (manufactured by Mitsui Miike Machinery Co., Ltd.), High-Speed Mixer (Fukae Powtec Corp.), and Vertical Granulator (manufactured by Powrex Corp.). A particular preference is given to a mixer comprising an agitating shaft along the center line of a horizontal, cylindrical blending vessel and agitating impellers arranged on the agitating shaft, to carry out blending of the components, including Lbdige Mixer (manufactured by Matsuzaka Giken Co., Ltd.), and PLOUGH SHARE Mixer (manufactured by PACIFIC MACHINERY & ENGINEERING Co., LTD.). In the case of the agitating mixer equipped with agitating impellers, a Froude number defined below, is preferably 1 to 12, more preferably 2 to 10, based on the rotation of the agitating impeller of the agitating mixer. From the viewpoint of suppressing an excessive agitating force and making the particle size distribution of the granules narrow, the Froude number is preferably 12 or less. Also, from the aspect of increasing blending efficiency, the Froude number is preferably 1 or more.

Here, the Froude number is defined as follows.

$$Fr=V^2/(R\times g),$$

wherein Fr stands for a Froude number, V stands for a peripheral speed of a tip end portion of an agitating impeller (m/s), R stands for a rotational radius (m) of an agitating impeller, and g stands for gravitational acceleration ($m/s^2$).

In step (2), although the granulation time for a granulation process by a batch process or the average residence time for granulating by a continuous process for obtaining a desired granulated product is not particularly limited, the granulation time or the average residence time is preferably from 2 to 20 minutes, more preferably from 3 to 10 minutes. From the viewpoint of accelerating the neutralization reaction, the granulation time or the average residence time is preferably 2 minutes or more, and from the viewpoint of productivity, the granulation time or the average residence time is preferably 20 minutes or less.

Surface-Coating Step

In the present invention, for the purpose of coating the surface of the granulated product, namely the crystalline alkali metal silicate granules, obtained after the granulation process in step (2), the method of the present invention may further comprise a surface-coating step wherein a fine powder is added as a surface coating agent. By coating the surface of the granulated product, the flowability and the non-caking property of the granulated product are likely to be improved, making it highly advantageous. The surface coating agent is added after the granulation process because when added at start or an intermediary stage of the granulation process, the surface coating agent is incorporated in the inner portion of the granulated product, thereby making unsatisfactory in the improvements for the flowability and the non-caking property of the granulated product. Here, "after the granulation process" refers to a point where a granulated product with a desired average particle size in the range of from 250 to 800 $\mu$m is produced upon granulation. Also, the fine powder preferably has an average primary-particle size of 10 $\mu$m or less. This means that the any fine powder may be used as long as it has an average particle size of 10 μm or less at the time which the fine powder coats the surface of the granulated product, including a case where an agglomerate of fine powder having an average particle size of from 20 to 30 μm is disintegrated, and then the granulated product is coated therewith during the surface-coating step. From the aspect of further improving the coating ratio of the surfaces of the granules, thereby easily producing desired crystalline alkali metal silicate granules, the average particle size is preferably 10 μm or less. The average particle size of the fine powder mentioned above may be measured by a method utilizing a light scattering, for example, "PARTICLE ANALYSER" (manufactured by Horiba, Ltd.), or a microscopic observation.

Preferred examples of the surface coating agents include aluminosilicates because of their actions as calcium ion capturing agents upon washing, with a particular preference given to aluminosilicates having an average primary particle size of 10 μm or less. The aluminosilicates may be crystalline or amorphous.

Besides the aluminosilicates, inorganic fine powders such as calcium silicates, silicon dioxide, bentonite, talc, clay, amorphous silica derivatives, each having an average primary particle size of 10 μm or less, are also preferred.

Examples of the aluminosilicates are listed for materials for inorganic builders and porous, oil-absorbing carrier. Also, metal soaps having an average primary particle size of 10 μm or less can be similarly used.

Among the above materials, a preference is given to one or more selected from the group consisting of crystalline or amorphous aluminosilicates and calcium silicates.

The amount of the fine powder used is preferably from 0.5 to 20 parts by weight, more preferably from 1 to 15 parts by weight, particularly from 2 to 10 parts by weight, based on 100 parts by weight of the crystalline alkali metal silicate granules obtained in step (2).

From the aspect of preventing dust generation, the amount of the fine powder is preferably 20 parts by weight or less, based on 100 parts by weight of the crystalline alkali metal silicate granules obtained in step (2). In addition, from the aspect of improving flowability and non-caking ability of the resulting silicate granules, the amount of the fine powder is preferably 0.5 parts by weight or more, based on 100 parts by weight of the crystalline alkali metal silicate granules obtained in step (2).

The devices used in the surface-coating step are not particularly limited, and any of known mixers can be used, with a preference given to the mixers exemplified in steps (1) and (2) mentioned above. In particular, mixers given in step (2) are suitably used.

The crystalline alkali metal silicate granules in the present invention are produced by the steps (1) and (2), preferably by steps (1) and (2) and a surface-coating step. For instance, step (2) and the surface-coating step can be carried out by a batch process using the devices given in the description of step (2). Alternatively, in the case where step (2) and the surface-coating step can be carried out by a continuous process, devices having such a construction that supplying of the starting materials and discharging of the granulated product are continuously carried out may be used.

In the case where the present invention is carried out by a batch process, steps (1) and (2) or steps (1), (2), and the surface-coating step can be carried out in the same device by using an agitating mixer used in step (2). Partial granulation takes place in step (1), and after completion of step (1), the mixture is further mixed and agitated, to thereby further progress the granulation. In the case where steps (1), (2), and the surface-coating step are carried out in the same device, a particular preference is given to those having an agitating mixing vessel containing a horizontal agitating shaft along the center line of the horizontal, cylindrical mixing vessel.

In the case where the present invention is carried out by a continuous process, steps (1) and (2) can be carried out in the same device by using an agitating mixer used in step (2). Steps (1) and (2), or step (2) and the surface-coating step, or steps (1), (2), and the surface-coating step may be continuously carried out in the same device as long as a mixing vessel has a partitioned structure (for instance, by providing partition plates) having partitions arranged perpendicular to the wall along the direction of the agitating shaft, the mixing vessel comprising an agitating mixing vessel containing a horizontal agitating shaft along the center line of the horizontal, cylindrical mixing vessel.

In addition, the amount of each of the detergent starting materials mentioned above supplied in the mixer is preferably 70 volume % or less, more preferably from 15 to 40 volume % of the entire volume in at any stage whether implementing a batch process or a continuous process. From the viewpoint of the blending efficiency of the detergent starting materials, the amount is preferably 70 volume % or less.

Further, in steps (1) and (2) in the present invention, or after the surface-coating step, the following additives may be added.

(1) Bleaching Agents

Examples thereof include sodium percarbonate, sodium perborate, sodium sulfate-hydrogen peroxide addition compounds, and the like.

(2) Enzymes

The enzymes are not particularly limited, and any of known enzymes generally used for detergents may be used. A preference is given to protease, cellulase, amylase, and lipase.

(3) Surfactant Powder

Examples thereof include powdery anionic surfactants, such as alkylbenzenesulfonates, alkyl or alkenyl ether sulfates, alkyl or alkenyl sulfates, α-olefinsulfonates, α-sulfonated fatty acid salts, α-sulfonated fatty acid esters, alkyl or alkenyl ether carboxylates, and soaps; powdery ampholytic surfactants such as carbobetaine-type and sulfobetaine-type ampholytic surfactants; powdery cationic surfactants such as di-long chain quaternary ammonium salts.

(4) Others

Examples of other additives include blueing agents, caking preventives, antioxidants, fluorescent dyes, photoactivated bleaching agents, perfumes, and redeposition agents, each of which is not being particularly limited, and any additives generally used for detergent may be used.

By using the granulation method in the present invention, the resulting detergent granules are advantageous because of having a larger compositional freedom, because the ratio of the powder starting materials and the nonionic surfactant constituting detergent starting materials can be arbitrarily chosen without having the following compositional restrictions:

(1) A compositional restriction in the granulation process in utilizing hydration of washing active salts.

(2) A compositional restriction in ensuring operational stability in solidification and disintegration method.

In addition, the granulated product obtained in the present invention may be blended in the detergent granular compositions containing an anionic surfactant as a base surfactant component produced by methods are disclosed in Japanese Patent Laid-Open Nos. 61-69897, 60-72999, 3-33199, 3-146599, 5-86400, 61-76597, 60-96698, 3-115400, and 2-29500, Japanese Patent Unexamined Publication No. 6-506720, Japanese Patent Laid-Open Nos. 4-81500, 61-272300, 1-311200, and Japanese Patent Unexamined Publication No. 6-502212 in suitable proportions.

The crystalline alkali metal silicate granules obtained in the present invention preferably have the following properties.

(1) Having a bulk density of from 0.6 to 1.2 g/ml, preferably 0.7 to 1.0 g/ml.

(2) Having an average particle size, obtained by a method explained below, of from 250 to 800 μm, preferably from 300 to 600 μm.

(3) Having a flowability in terms of flow time, which is a time period required for dropping 100 ml of powder from a hopper used in a measurement of bulk density according to JIS K 3362, of 10 seconds or shorter, preferably 8 seconds or shorter.

(4) Having a caking property evaluated by sieve permeability, obtained by a method explained below, of 90% or more, preferably 95% or more.

(5) Having an exudation property determined by gross examination measured by the method described in Examples given hereinbelow of two ranks or better, preferably 1 rank.

(6) Having a percentage of weight increase, obtained by a method explained below, of 10% or less, preferably 8% or less.

(7) Having solubility at start of 0.5% or less, preferably 0.3% or less, and solubility after passage of given time of 1.0% or less, preferably 0.8% or less.

(8) Having a water content in the granules, obtained by a method explained above, of 5% by weight or less, preferably 3% by weight or less, more preferably 1% by weight or less.

(9) Having a blocking property as evaluated by a container remaining ratio, obtained by a method explained below, of preferably 20% by weight or less, more preferably 10% by weight or less, particularly 5% by weight or less.

(10) Having a particle breaking strength, obtained by a method explained below, of preferably 20 gf or more, more preferably 30 gf or more.

Here, the bulk density is preferably 1.2 g/ml or less from the viewpoint of the solubility of the obtained detergent granules. The average particle size is preferably 800 μm or less from the viewpoint of the solubility of the detergent granules, and preferably 250 μm or more from the viewpoint from inhibiting the generation of powder dusts. The flowability in terms of the flow time is preferably 10 seconds or shorter from the viewpoint of ease of handling of the resulting detergent granules. The caking property evaluated by sieve permeability is preferably 90% or more from the viewpoint of inhibiting the caking phenomenon upon storage. The exudation property determined by gross examination is preferably two ranks or better from the viewpoint of preventing the adhesion of the nonionic surfactant-containing granules to conveying equipment. The percentage of weight increase is preferably 10% or less from the viewpoint of obtaining good performance of the crystalline alkali metal silicate and inhibiting the caking phenomenon of the obtained silicate granules. The solubility at start is preferably 0.5%, and the solubility after passage of time is preferably 1.0%, from the viewpoint of preventing adhesion to washed clothes when washed at low temperatures. The water content is preferably 5% by weight from the viewpoint of improvement in the solubility of the silicate granules, increases in the chelating ability and alkalizing ability, and prevention of the generation of the caking phenomenon.

2. The granular detergent composition for clothes washing having high bulk density of the present invention The granular detergent composition for clothes washing having high bulk density of the present invention, which is obtainable-by the method of the present invention described above, will be detailed below.

The granular detergent composition for clothes washing having high bulk density of the present invention has a bulk density of from 0.6 to 1.2 g/ml and comprises the following components:

(I) surfactant components at least comprising:

A) an polyoxyethylene alkyl ether; and

B) an anionic surfactant capable of having a lamellar orientation, wherein a total amount of component A and component B is 80% by weight or more of the entire surfactant components, and wherein the weight ratio of component A to component B is A/B=20/1 to 1/1;

(II) C) crystalline alkali metal silicates having an $SiO_2/M_2O$ molar ratio of 1.5 to 2.6, wherein M stands for an alkali metal atom; and (III) D) metal ion capturing agents other than component C having a calcium ion capturing ability of 200 $CaCO_3$ mg/g or more, wherein component I, component II, and component III are present within one granule, and wherein a total amount of component I, component II, and component III is from 70 to 100% by weight of the entire granular detergent composition, wherein the weight ratio of component II to component I is II/I=9/1 to 9/11, and wherein the weight ratio of component II to component III is II/III=4/1 to 1/15.

Each of components A, B, C, and D will be detailed below.

The polyoxyethylene alkyl ethers constituting component A in the above granular detergent composition of the present invention are nonionic surfactants. When compared with alkylbenzenesulfonates and alkylsulfates which are usually used in detergents, the polyoxyethylene alkyl ethers have low critical micelle concentration c.m.c.), so that excellent detergency can be performed even at low concentrations. In the present invention, a greater preference for component A is given to polyoxyethylene alkyl ethers which are alkylene oxide adducts of alcohols each having an average number of carbon atoms from 10 to 18, each of the ethylene oxide adducts having an average molar amount of from 5 to 15, with a greatest preference given to alkylene oxide adducts of alcohols having an average number of carbon atoms from 12 to 14, each of the ethylene oxide adducts having an average molar amount of from 5 to 10. Here, nonionic surfactants which are ethylene oxide adducts with relatively sharp distribution of molar numbers as those disclosed in Japanese Patent Laid-Open No. 3-265695 may be also used.

The crystalline alkali metal silicates constituting component C usually have $SiO_2/M_2O$ molar ratios of from 1.5 to 2.6, wherein M stands for an alkali metal atom. Incidentally, the crystalline alkali metal silicates used in patent publications discussed in BACKGROUND ART section of the present invention have $SiO_2/Na_2O$ molar ratios (S/N ratio) of from 1.9 to 4.0. However, in the present invention, when the crystalline alkali metal silicates having the $SiO_2/M_2O$ ratios exceeding 2.6 cannot have the effects achieved by the present invention, thereby making it impossible to produce detergents having washing power with a remarkable reduction in the standard amount of dosage.

Among the crystalline alkali metal silicates constituting component C, a preference is given to those exemplified as having the following compositions (3) and (4) given below.

$$xM_2O.ySiO_2.zMe_mO_n.wH_2O, \quad (3)$$

wherein M stands for an element in Group Ia of the Periodic Table; Me stands for one or more elements selected from the group consisting of Group IIa, IIb, IIa, IVa, and VIII; x, y, z, and w each represents a molar number, wherein y/x is from 1.5 to 2.6; z/x is from 0.01 to 1.0; n/m is from 0.5 to 2.0; and w is from 0 to 20; and $$M_2O.x'SiO_2.y'H_2O, \quad (4)$$

wherein M stands for an alkali metal atom; x' and y' each represents a molar number, wherein x' is from 1.5 to 2.6; and y' is from 0 to 20.

First, the crystalline alkali metal silicates having the general formula (3) above will be detailed below.

In the general formula (3), M stands for an element selected from Group Ia of the Periodic Table, wherein the Group Ia elements may be exemplified by Na, K, etc. The Group Ia elements may be used alone, or in combination of two or more kinds. For instance, such compounds as $Na_2O$ and $K_2O$ may be mixed to constitute an $M_2O$ component.

Me stands for one or more elements selected from the group consisting of Group IIa, IIb, IIIa, IVa, and VIII of the Periodic Table, and examples thereof include Mg, Ca, Zn, Y, Ti, Zr, and Fe, which are not particularly limited to the above examples. Here, a preference is given to Mg and Ca from the viewpoint of resource stock and safety. In addition, these elements may be used alone, or in combination of two or more kinds. For instance, such compounds as MgO and CaO may be mixed to constitute an $Me_mO_n$ component.

In addition, the crystalline alkali metal silicates in the present invention may be in the form of hydrates, wherein the amount of hydration (w) is usually in the range of from 0 to 20 moles of $H_2O$.

With respect to the general formula (3), y/x is from 1.5 to 2.6, preferably from 1.5 to 2.2. From the aspect of anti-solubility in water, y/x is preferably 1.5 or more, and from the aspect of alkalizing ability, y/x is preferably 2.6 or less. When the anti-solubility in water is insufficient, powder properties of the detergent composition, such as caking properties, solubility, etc. are drastically lowered. When y/x exceeds 2.6, the alkalizing ability is lowered, and it is insufficient to be used as an alkalizer, and it also has a low ion exchange capacity, thereby making it insufficient to be used as an ion exchange material.

With respect to z/x, it is from 0.01 to 1.0, preferably from 0.02 to 0.9. From the aspect of the anti-solubility in water, z/x is preferably 0.01 or more, and from the aspect of the ion exchange capacity, z/x is preferably 1.0 or less.

With respect to x, y and z, there are no limitations, as long as y/x and z/x have the above relationships. When $xM_2O$, for example, is $x'Na_2O.x''K_2O$ as described above, x equals to x'+x". The same can be said for z when $Zme_mO_n$ comprises two or more components. Further, "n/m is from 0.5 to 2.0" indicates the number of oxygen ions coordinated to the above elements, which actually takes values selected from 0.5, 1.0, 1.5, and 2.0.

The crystalline alkali metal silicate having the general formula (3) consists of three components, $M_2O$, $SiO_2$, and $Me_mO_n$. Materials which can be converted to each of these components, therefore, are indispensable for starting materials for producing the crystalline alkali metal silicates in the present invention. In the present invention, known compounds can be suitably used for starting materials for the crystalline alkali metal silicates without limitations. Examples of the $M_2O$ component and the $Me_mO_n$ component include simple or complex oxides, hydroxides and salts of respective elements; and minerals containing respective elements. Specifically, examples of the starting materials for the $M_2O$ component include NaOH, KOH, $Na_2CO_3$, $K_2CO_3$, and $Na_2SO_4$. Examples of the starting materials for the $Me_mO_n$ component include $CaCO_3$, $MgCO_3$, $Ca(OH)_2$, $Mg(OH)_2$, MgO, $ZrO_2$, and dolomite. Examples of the starting materials for the $SiO_2$ component include silica sand, kaolin, talc, fused silica, and sodium silicate.

The method of producing the crystalline alkali metal silicate having the general formula (3) may be exemplified by blending these starting material components to provide a desired composition in x, y, and z for the crystalline alkali metal silicate, and baking the resulting mixture at a temperature in the range of usually from 300 to 1500° C., preferably from 500 to 1000° C., more preferably from 600 to 900° C., to form crystals. In this case, when the heating temperature is less than 300° C., the crystallization is likely to be insufficient, which may result in poor anti-solubility in water of the resulting crystalline alkali metal silicate, and when the heating temperature exceeds 1500° C., coarse grains are likely to be formed, which may result in a decrease in the ion exchange capacity of the resulting crystalline alkali metal silicate. The heating time is usually 0.1 to 24 hours. Such baking can usually be carried out in a heating furnace such as an electric furnace or a gas furnace.

The crystalline alkali metal silicate having the general formula (3) obtained above has an excellent alkalizing ability, to a level wherein its maximum pH value exceeds 11.0 at 20° C. in a 0.1% by weight dispersion. In addition, the crystalline alkali metal silicate particularly has an excellent alkaline buffering effects, showing remarkably superior alkaline buffering effects when compared to those of sodium carbonate and potassium carbonate.

Moreover, the above crystalline alkali metal silicate preferably has an ion exchange capacity of 100 $CaCO_3$ mg/g or more, more preferably from 200 to 600 $CaCO_3$ mg/g. Therefore, the crystalline alkali metal silicate is one of the materials having ion capturing ability in the present invention.

Since the crystalline alkali metal silicate having the general formula (3) has not only good alkalizing ability and alkaline buffering effects but also good ion exchange capacity, the washing conditions are suitably adjusted by adding suitable amounts of the crystalline alkali metal silicate.

In the granular detergent composition for clothes washing having high bulk density of the present invention, the crystalline alkali metal silicate has an average particle size preferably of from 0.1 to 50 $\mu$m, more preferably from 1 to 30 $\mu$m, still more preferably from 1 to 10 $\mu$m. From the aspect of preventing the lowering of the ion exchange speed, the average particle size of the crystalline alkali metal silicate is preferably 50 $\mu$m or less. In addition, from the viewpoint of having an even smaller specific surface area, the average particle is preferably 0.1 $\mu$m or more. When the ion exchange speed is slowed down, the detergency is liable to be lowered, and as the specific surface area is increased, the hygroscopic property and the $CO_2$ absorption property are increased, which in turn makes it likely to cause drastic quality deterioration. Incidentally, the average particle size referred herein is a median diameter obtained from a particle size distribution.

The crystalline alkali metal silicate having the average particle size and the particle size distribution described above is prepared by pulverizing using pulverizing devices, such as vibration mills, hammer mills, ball-mills, and roller mills.

Next, the crystalline alkali metal silicates having the general formula (4) above will detailed below.

These crystalline alkali metal silicates are represented by the general formula (4):

$$M_2O.x'SiO_2.yH_2O, \quad (4)$$

wherein M stands for an alkali metal atom; x' is from 1.5 to 2.6; and y' is from 0 to 20.

Among them, a preference is given to the crystalline alkali metal silicates having x' and y' in the general formula (4) such that each satisfies $1.7 \leqq x' \leqq 2.2$ and $y'=0$, and those having a cationic exchange capacity of preferably 100 $CaCO_3$ mg/g or more, more preferably from 200 to 400 $CaCO_3$ mg/g, are usable. The above crystalline alkali metal silicates are one of the materials having ion capturing ability in the present invention.

Since the crystalline alkali metal silicate usable in the present invention has not only good alkalizing ability and alkaline buffering capacity but also good ion exchange capacity, the washing conditions are suitably adjusted by adding suitable amounts of the crystalline alkali metal silicate.

The content of the crystalline alkali metal silicate is preferably 4 to 75% by weight in the entire composition, with a particular preference given to the following compositions depending upon the water hardness of the water for washing used.

1) In the case of using water for washing having a water hardness of from 2 to 6° DH, 25 to 55% by weight of the crystalline alkali metal silicate in the entire composition;
2) In the case of using water for washing having a water hardness of from 6 to 10° DH, 10 to 45% by weight of the crystalline alkali metal silicate in the entire composition; and
3) In the case of using water for washing having a water hardness of from 10 to 20° DH, 5 to 30% by weight of the crystalline alkali metal silicate in the entire composition.

A method for producing the above crystalline alkali metal silicates is disclosed in Japanese Patent Laid-Open No. 60-227895. However, the crystalline alkali metal silicates may be generally produced by baking glassy amorphous sodium silicate at a temperature of from −200 to 1000° C. Details of the production method is disclosed in "Phys. Chem. Glasses, 7, pp.127–138 (1966) Z. Kristallogr., 129, pp.396–404(1969)." Also, the crystalline alkali metal silicates are commercially available in powdery or granular forms under a trade name "Na-SKS-6" ($\delta$-$Na_2Si_2O_5$) (manufactured by Hoechst).

In the present invention, as in the case for the crystalline alkali metal silicates having the composition (3), the crystalline alkali metal silicates having the composition (4) have an average particle size of preferably from 0.1 to 50 $\mu$m, more preferably from 1 to 30 $\mu$m, still more preferably from 1 to 10 $\mu$m.

In the present invention, the crystalline alkali metal silicate having the general formula (3) and the crystalline alkali metal silicate having the general formula (4) may be used alone or in combination. It is preferred that the total amount of the crystalline alkali metal silicates is 50 to 100% by weight of the entire alkalizer content, more preferably 70 to 100% by weight.

The metal ion capturing agents other than the crystalline alkali metal silicates constituting component D in the above granular detergent composition of the present invention have a calcium ion capturing ability of 200 $CaCO_3$ mg/g or higher, and any of those metal ion capturing agents which are usually used in detergents are usable.

In particular, a preference is given to an aluminosilicate having an ion exchange capacity of 200 $CaCO_3$ mg/g or higher and having the following formula (5):

$$x''(M_2O).Al_2O_3.y''(SiO_2).w''(H_2O), \quad (5)$$

wherein M stands for an alkali metal atom, such as sodium atom or potassium atom; x", y", and w" each stands for a molar number of each component; and generally, x" is from 0.7 to 1.5; y" is from 0.8 to 6.0; and w" is from 0 to 20.

The aluminosilicates mentioned above may be crystalline or amorphous, and among the crystalline aluminosilicates, a particular preference is given to those having the following general formula:

$$Na_2O.Al_2O_3O.Ysio_2.wH_2O,$$

wherein y is a number of from 1.8 to 3.0; and w is a number of from 1 to 6.

As for the crystalline aluminosilicates (zeolites), synthetic zeolites having an average, primary particle size of from 0.1 to 10 $\mu$m, which are typically exemplified by A-type zeolite, X-type zeolite, and P-type zeolite, are suitably used. The zeolites may be used in the forms of powder, a zeolite slurry, or dried particles comprising zeolite agglomerates obtained by drying the slurry. The zeolites of the above forms may also be used in combination.

The above crystalline aluminosilicates are obtainable by conventional methods. For instance, methods disclosed in Japanese Patent Laid-Open Nos. 50-12381 and 51-12805 may be employed.

On the other hand, the amorphous aluminosilicates represented by the same general formula as the above crystalline aluminosilicate are also obtainable by conventional methods. For instance, the amorphous aluminosilicates are prepared by adding an aqueous solution of a low-alkaline metal aluminate having a molar ratio of $M_2O$ to $Al_2O_3$ (M standing for an alkali metal atom) of $M_2O/Al_2O_3$=1.0 to 2.0 and a molar ratio of $H_2O$ to $M_2O$ of $H_2O/M_2O$=6.0 to 500 to an aqueous solution of an alkali metal silicate having a molar ratio of $SiO_2$ to $M_2O$ of $SiO_2/M_2O$=1.0 to 4.0 and a molar ratio of $H_2O$ to $M_2O$ of $H_2O/M_2O$=12 to 200 under vigorous stirring at usually 15 to 60° C., preferably 30 to 50° C.

The intended product can be advantageously obtained by heat-treating a white slurry of precipitates thus formed at 70 to 100° C., preferably 90 to 100° C., for usually 10 minutes or more and 10 hours or less, preferably 5 hours or less, followed by filtration, washing and drying. Incidentally, the aqueous solution of an alkali metal silicate may be added to the aqueous solution of a low-alkaline alkali metal aluminate.

By this method, the oil-absorbing amorphous aluminosilicate carrier having an ion exchange capacity of 100 $CaCO_3$ mg/g or more and an oil-absorbing capacity of 80 ml/100 g or more can be easily obtained (see Japanese Patent Laid-Open Nos. 62-191417 and 62-191419).

In addition, a preference is given to the metal ion capturing agents containing a carboxylate polymer having a calcium ion capturing ability of 200 $CaCO_3$ mg/g or more. Examples of the above carboxylate polymer include polymers or copolymers, each having repeating units represented by the general formula (6):

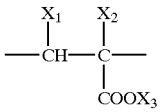

(6)

wherein $X_1$ stands for a methyl group, a hydrogen atom, or a $COOX_3$ group; $X_2$ stands for a methyl group, a hydrogen atom, or a hydroxyl group; $X_3$ stands for a hydrogen atom, an alkali metal ion, an alkaline earth metal ion, an ammonium ion, or 2-hydroxyethylammonium ion.

In the general formula (6), examples of the alkali metal ions include Na, K, and Li ions, and examples of the alkaline earth metal ions include Ca and Mg ions.

Examples of the polymers or copolymers usable in the present invention include those obtainable by polymerization reactions of acrylic acid, (anhydrous) maleic acid, methacrylic acid, α-hydroxyacrylic acid, crotonic acid, isocrotonic acid, and salts thereof; copolymerization reactions of each of the monomers; or copolymerization reactions of the above monomers with other polymerizable monomers. Here, examples of the other polymerizable monomers used in copolymerization reaction include aconitic acid, itaconic acid, citraconic acid, fumaric acid, vinyl phosphonic acid, sulfonated maleic acid, diisobutylene, styrene, methyl vinyl ether, ethylene, propylene, isobutylene, pentene, butadiene, isoprene, vinyl acetate (vinyl alcohols in cases where hydrolysis takes place after copolymerization), and acrylic acid ester, without particularly being limited thereto. Incidentally, the polymerization reactions are not particularly limited, and any of the conventionally known methods may be employed.

Also, polyacetal carboxylic acid polymers such as polyglyoxylic acids disclosed in Japanese Patent Laid-Open No. 54-52196 are also usable for the polymers in the present invention.

In the present invention, the above polymers and copolymers preferably have a weight-average molecular weight of from 800 to 1,000,000, more preferably from 5,000 to 200,000.

Also, in the case of copolymers, although the copolymerization ratios between the repeating units of the general formula.(6) and other polymerizable monomers are not particularly limited, a preference is given to copolymerization ratios of the repeating units of general formula (6)/other polymerizable monomer=1/100 to 90/10.

In the present invention, the above polymer or copolymer is contained in the entire composition in an amount of preferably from 1 to 50% by weight, more preferably from 2 to 30% by weight, particularly from 5 to 15% by weight.

Beside the ones listed above, examples of D components include aminotri(methylenephosphonic acid), 1-hydroxyethylidene-1,1-diphosphonic acid, ethylenediaminetetra(methylenephosphonic acid), diethylenetriaminepenta(methylenephosphonic acid), and salts thereof; salts of phosphonocarboxylic acids, such as salts of 2-phosphonobutane-1,2-dicarboxylic acid; amino acid salts, such as salts of aspartic acid and salts of glutamic acid; aminopolyacetates, such as nitrilotriacetates and ethylenediaminetetraacetates.

The features of the present invention are to give excellent detergency with small amounts of detergents used and powder properties. As one condition for achieving excellent detergency performance with small amounts of dosage of detergents, amount reduction of the constituting ingredients may be considered.

The nonionic surfactants usable in the present invention are in liquid states at an ambient temperature, which usually require porous, oil-absorbing carriers in order to powderize the nonionic surfactants.

Japanese Patent Laid-Open Nos. 61-89300, 51-41708, 5-5100, and 4-339898 disclose the use of clay materials, such as silica compounds, calcium carbonate, and bentonite, as oil-absorbing carriers. However, since these oil-absorbing carriers cannot be expected to have any significant effects as detergent builders, when these components are added in detergent compositions, the proportions of the effective ingredients contributing to washing in detergent compositions are merely lowered. Therefore, with an exception to the cases of the amorphous aluminosilicates mentioned above, these oil-absorbing carriers are not desirable from the viewpoint of obtaining detergents giving good washing power with small amounts of dosage. Among the oil-absorbing carriers, amorphous aluminosilicates obtainable by a particular production method have ion exchange capacity as well as oil-absorbing ability. However, it would be difficult to achieve an ion exchange capacity equivalent to a level of zeolites,.which are crystalline aluminosilicates. Therefore, even if the amorphous aluminosilicates were used as the oil-absorbing carriers, they need to be formulated in notably large amounts as compared to the zeolites when considering their functions as builders. Therefore, the amounts of dosage of such detergents would depart from that of the present invention, wherein the amount of dosage of detergents is to be reduced.

Japanese Patent Laid-Open Nos. 6-10000 and 6-116600 disclose compositions comprising nonionic surfactants, oil-absorbing carriers, and crystalline alkali metal silicates, the crystalline alkali metal silicates being essentially the same as the present invention. However, since the amount of the nonionic surfactants is varied in proportion to the oil-absorbing carriers and other powdery ingredients, thereby resulting in compositional restrictions.

On the other hand, methods of powdering nonionic surfactants without using oil-absorbing carriers are also known. For instance, Japanese Patent Laid-Open No. 62-263299 discloses a method of powdering nonionic surfactants by formulating relatively large amounts of sodium carbonate and zeolite. Japanese Patent Laid-Open No. 61-138697, Japanese Patent Unexamined Publication No. 3-504734, and Japanese Patent Laid-Open No. 57-173000 disclose methods for powdering nonionic surfactants by impregnating nonionic surfactants in porous, spray-dried particles obtainable by spray-drying a slurry containing an inorganic salt, such as zeolite, carbonates, and sulfates. However, since powdery ingredients usually used in detergents do not basically have properties which are suitable for keeping the nonionic surfactants in liquid states, the problems of caking and exudation cannot be sufficiently solved. In addition, in the case where the spray-dried particles are used, since the amount of the amorphous sodium silicate added for the purpose of keeping the strength of the spray-dried particles is restricted in order to prevent the formation of water-insoluble products, the strength of the resulting spray-dried particles becomes insufficiently low. Therefore, while a delicate spray-drying operation is required, those with micropores sufficient for impregnation cannot be obtained, so that techniques for stably formulating large amounts of nonionic surfactants are extremely difficult when compared with those using the oil-absorbing carriers.

In the present invention, by using the polyoxyethylene alkyl ether constituting component A and the anionic surfactant capable of having a lamellar orientation constituting component B in combination, the amount of the oil-absorbing carrier can be made notably lower without a substantial loss in the powder properties when compared with conventional detergents having nonionic surfactants as main ingredients, thereby making it possible to produce detergents having good detergency with notably smaller amount of dosage. Examples of the anionic surfactants usable for surfactants capable of having a lamellar orientation constituting component B include one or more compounds selected from the group consisting of salts of saturated or unsaturated fatty acids having 10 to 22 carbon atoms; salts of alkylsulfuric acids having 10 to 22 carbon atoms; salts of α-sulfonated fatty acids having 10 to 22 carbon atoms; and salts of polyoxyethylene alkyl ether sulfuric acids whose alkyl moieties have 10 to 22 carbon atoms and whose ethylene oxide moieties have an average additional molar number of from 0.2 to 20. Among the salts, a preference is given to the alkali metal salts. Among these anionic surfactants, the greatest preference is given to the salts of the fatty acids. In cases where the salts of the fatty acids are used, the average number of carbon atoms is desirably 13 or more from the viewpoint of easiness in providing a lamellar orientation, and the average number of carbon atoms is desirably 17 or less from the viewpoint of solubility. In particular, those containing salts of saturated fatty acids with 16 carbon atoms in amounts of 30% by weight or more in the entire salts of fatty acids are most highly preferred. Because of the easiness in having lamellar orientation, and the solubility of the resulting granules, the preferred amounts of the salts of the saturated fatty acid having 12 carbon atoms, the unsaturated fatty acids having 12 to 18 carbon atoms, and the saturated fatty acid having 18 carbon atoms are, respectively, 50% by weight or less, and more preferably 25% by weight or less, of the entire salts of the fatty acids. Here, the amount (weight) of these anionic surfactants is expressed in a weight basis of acid forms thereof.

The anionic surfactants capable of having a lamellar orientation constituting component B may be formulated so as to have the total amount of component A and component B is 80% by weight or more, preferably 90% by weight or more, in the entire surfactant. In addition, when the proportion of component A to component B satisfies a weight ratio A/B=20/1 to 1/1, preferably from 10/1 to 4/3, excellent detergency and powder properties are shown.

In addition, in the present invention, it may be possible to lower the amount of water-soluble, crystalline inorganic salts, such as alkali metal carbonates and alkali metal sulfates, to 10% by weight or less.

By containing component A and component B in the above-mentioned weight ratios and amounts, it is made possible to reduce the amount of the oil-absorbing carriers. However, in order to achieve good detergency with small amounts of dosage in the present invention, the surfactants, the crystalline alkali metal silicates, and the metal ion capturing agents are needed to be blended in particular ratios. The crystalline alkali metal silicates are as described above. In particular, since the crystalline, layered sodium silicates disclosed in Japanese Patent Laid-Open No. 60-227895 show alkalizing ability as well as ion exchange capacity, there have been suggested to reduce the amount of dosage by substituting metal ion capturing agents, such as zeolites and salts of polycarboxylic acids, and sodium carbonate and sodium silicate (amorphous), which have been added in separate granules in conventional detergents, with the crystalline, layered sodium silicates. For instance, in Japanese Patent Laid-Open No. 7-53992, the ratio between the detergent builder and the crystalline alkali metal silicates is limited when the detergent builders containing zeolites are replaced by crystalline alkali metal silicates.

However, the present inventors have found that simple substitution would not solve the problems. This is because simple substitution would cause loss of balance in the overall detergents, so that sufficient detergency cannot be achieved. In the present invention, the metal ion capturing agents other than the crystalline alkali metal silicates are essential ingredients, and the effects of the present invention cannot be obtained unless the metal ion capturing agents are formulated in a particular proportion to the crystalline alkali metal silicate. In addition, the present inventors have found that by adding the crystalline alkali metal silicates and other metal ion capturing agents in particular proportions, the surfactant concentration in the washing liquid is notably lowered.

Therefore, the granular detergent composition of the present invention comprises component I as surfactant components, component II as crystalline alkali metal silicate components, and component III as metal ion capturing agent components other than crystalline alkali metal silicates, wherein the total amount of component I, component II, and component III is 70 to 100% by weight of the entire granular detergent composition, and wherein the weight ratio of component II to component I is II/I=9/1 to 9/11, and the weight ratio of component II to component III is II/III=4/1 to 1/15.

A greater preference is given to the granular detergent composition containing the components I to III above, wherein a total amount of component I, component II, and component III is 80 to 100% by weight of the entire composition, and wherein the weight ratio of component II to component I is II/I=9/1 to 1/1, and the weight ratio of component II to component III is II/III=3/1 to 1/15. Particularly, a total amount of component I, component II, and component III is 80 to 100% by weight of the entire composition, wherein the weight ratio of component II to component I is II/I=4/1 to 1/1, and the weight ratio of component II to component III is II/III=3/1 to 1/15. Most preferably, the weight ratio of component II to component III is II/III=3/1 to 3/7, in the case where the water for washing has a water hardness of from 2 to 6° DH; or II/III=4/3 to 1/6, in the case where the water for washing has a water hardness of from 6 to 10° DH; or II/III=1/1 to 1/15, in the case where the water for washing has a water hardness of from 10 to 20° DH.

In the present invention, by having the above composition, a detergent composition having a remarkably smaller standard amount of dosage for each of the water for washing having different water hardness can be obtained.

As for other nonionic surfactants, those usually formulated in detergents may be used. Examples thereof include the following:

Polyoxyethylene alkylphenyl ethers, polyoxyethylene sorbitan fatty acid esters, polyoxyethylene sorbitol fatty acid esters, polyoxyethylene fatty acid esters, polyoxyethylene alkyl ether carboxylate alkyl esters, polyoxyethylene polyoxypropylene alkyl ethers, polyoxyethylene castor oils, polyoxyethylene alkylamines, glycerol fatty acid esters, higher fatty acid alkanolamides, alkylglucosides, alkylglucosamides, and alkylamine oxides.

Examples of the anionic surfactants include alkylbenzenesulfonates, α-olefinsulfonates, α-sulfofatty acid ester salts, alkyl or alkenyl ether carboxylates, amino acid-type surfactants, and N-acyl amino acid-type surfactants, with a preference given to alkylbenzenesulfonates.

Examples of the cationic surfactants include quaternary ammonium salts, such as alkyl trimethylamine salts. Examples of the amphoteric surfactants include carboxy-type and sulfobetaine-type amphoteric surfactants.

These surfactants may be added in amounts so as not to lower the powder properties or to increase the standard amount of dosage of the resulting detergents.

Examples of other ingredients which may be added to the detergent composition in the present invention as alkalizers besides amorphous alkali metal silicates include various compounds including alkali metal salts such as alkali metal carbonates and alkali metal sulfites, and organic amines, such as alkanolamines.

In addition, color-fading preventives, and anti-redeposition agents generally used for detergent compositions, including non-dissociating polymers such as polyethylene glycols, polyvinyl alcohols, and polyvinyl pyrrolidones; organic acid salt builders, such as diglycolates and oxycarboxylates; and carboxymethyl cellulose may be optionally used.

Besides the above, the following ingredients may be also contained in the detergent composition of the present invention. Specifically, the detergent composition of the present invention may contain one or more ingredients selected from enzymes, such as protease, lipase, cellulase, and amylase; caking preventives, such as lower alkylbenzenesulfonates whose alkyl moieties have about 1 to 4 carbon atoms, sulfosuccinates, talc, and calcium silicates; antioxidants, such as tert-butylhydroxytoluene, and distyrenated cresol; bleaching agents, such as sodium percarbonate; bleaching activators, such as tetraacetyl ethylenediamine; fluorescent dyes; blueing agents; and perfume, without being particularly limited thereto, to give compositions suitable for their purposes.

The granular detergent compositions of the present invention contain each of the components described above, and they may be, for instance, produced by the method of the present invention described above. Here, the detergent compositions may be produced by any other methods without being limited thereto.

The granular detergent composition of the present invention obtainable by the method described above is preferably coated by inorganic materials having an average particle size of 10 $\mu$m or less from the aspect of powder properties, with a particular preference given to a case where the granular detergent composition is coated with amorphous sodium aluminosilicate.

The present invention is concerned with granular detergents having high bulk density, which may be used as base detergents, to which other granular ingredients, such as bleaching agents and enzymes, may be formulated in the final products. Of course, detergents only consisting of the granules having the above constitution can be prepared into final products.

The standard amount of dosage per one washing cycle of the granular detergent composition having a high bulk density of the present invention described above may be preferably from 10 to 20 g and 9 to 30 ml, more preferably from 12 to 18 g and from 15 to 25 ml, to 30 liters of water for washing.

The washing method of the present invention comprises the step of washing clothes by adding the granular detergent composition having a high bulk density described above in an amount of dosage so as to satisfy a surfactant concentration in the washing liquid of preferably from 0.07 to 0.17 g/L, more preferably from 0.10 to 0.15 g/L.

The method of the present invention will be explained in detail below by means of the following Examples and Comparative Examples, without intending to limit the scope of the present invention thereto.

In the following Examples 1 to 13 and Comparative Examples 1 to 5, the polyoxyethylene dodecyl ether has an average molar number of ethylene oxide adduct of 8, a melting point of 15° C., and an HLB of 10.14. The crystalline alkali metal silicate has the composition of $Na_2O.2SiO_2$, the maximum pH value at 20° C. in 0.1% by weight dispersion of the crystalline alkali metal silicate is 11.5, and the crystalline alkali metal silicate has the ion exchange capacity of 224 $CaCO_3$ mg/g. The amorphous aluminosilicate is a product manufactured by Kao Corporation, which has the composition of $Na_2O.Al_2O.3SiO_2$, the microporous capacity of 245 $cm^3$/100 g, the specific surface area of 64 $m^2$/g, the amount of oil absorbed of 180 mL/100 g, water content at absolute dryness (800° C., 1 HR) of 26.5% by weight, and the primary particle size of 0.05 $\mu$m, whose 1 g/liter solution has a pH at 20° C. of 10.4. ZEOLITE 4A is a product manufactured by Tosoh Corporation, whose 1 g/liter solution has a pH at 20° C. of 9.8.

Incidentally, the water content of each of ingredients are as follows:

The polyoxyethylene dodecyl ether: 0.3% by weight.

The crystalline alkali metal silicate: 0.1% by weight.

The amorphous aluminosilicate: 13.2% by weight.

ZEOLITE 4A: 7.3% by weight.

The polyethylene glycol: 0.1% by weight.

Palmitic acid: 0.1% by weight.

Laurylsulfuric acid: 0.3% by weight.

Also, the melting points of the nonionic surfactants used in Examples were as follows:

The polyoxyethylene dodecyl ether: 15° C.

The polyethylene glycol: 55° C.

Palmitic acid: 63° C.

Laurylsulfuric acid: 38° C.

EXAMPLE 1

20 parts by weight of a nonionic surfactant and 15 parts by weight of a fatty acid listed in Table 1 were blended while heating the mixture to a temperature of 70° C., to prepare a liquid mixture. Next, 65 parts by weight of crystalline alkali metal silicate were supplied in Lodige Mixer (manufactured by Matsuzaka Giken Co., Ltd.; capacity: 20 liters; equipped with a jacket), and agitation was initiated with the mixer having a main axis (150 rpm) and a chopper (4,000 rpm). Incidentally, heated water of 75° C. was supplied in the jacket at a flow rate of 10 liters/minute. To the above mixer, the liquid mixture was added in a period of 4 minutes, and after the added mixture was agitated for 6 minutes, the resulting crystalline alkali metal silicate granules were discharged. The entire amount supplied was 4 kg.

The evaluation results for the resulting crystalline alkali metal silicate granules are shown in Table 3.

EXAMPLE 2

The starting materials listed in Table 1 were subjected to a granulation treatment in the same manner as in Example 1, to give crystalline alkali metal silicate granules. Thereafter, 3 parts by weight of the amorphous aluminosilicate used as a surface coating agent were supplied in the Lödige Mixer used above containing the crystalline alkali metal silicate granules. After the obtained mixture was agitated for 1.5 minutes, the resulting coated crystalline alkali metal silicate granules were discharged. The evaluation results for the resulting crystalline alkali metal silicate granules are shown in Table 3.

EXAMPLE 3

Seventy parts by weight of the crystalline alkali metal silicate listed in Table 1 were supplied in Lödige Mixer (manufactured by Matsuzaka Giken Co., Ltd.; capacity: 20 liters; equipped with a jacket), and agitation was initiated. Twenty parts by weight of a nonionic surfactant and 10 parts by weight of a fatty acid listed in Table 1, each heated to 75° C., were supplied to the mixer simultaneously while agitating in a period of 3 minutes without blending the nonionic surfactant and the fatty acid in advance. Thereafter, the added mixture was agitated for 6 minutes. Incidentally, the agitation was carried out with the mixer having a main axis (150 rpm) and a chopper (4,000 rpm) while supplying heated water of 75° C. in the jacket at a flow rate of 10 liters/minute. Further, 3 parts by weight of the amorphous aluminosilicate used as a surface coating agent were supplied in the Lödige Mixer containing the crystalline alkali metal silicate granules. After the obtained mixture was agitated for 1.5 minutes, the resulting coated crystalline alkali metal silicate granules were discharged. The evaluation results for the resulting crystalline alkali metal silicate granules are shown in Table 3.

EXAMPLE 4

20 parts by weight of a nonionic surfactant and 15 parts by weight of an alkylsulfuric acid listed in Table 1 were blended while heating the mixture to a temperature of 30° C., to prepare a liquid mixture. Next, 65 parts by weight of the crystalline alkali metal silicate were supplied in Lödige Mixer (manufactured by Matsuzaka Giken Co., Ltd.; capacity: 20 liters; equipped with a jacket), and agitation was initiated in the same manner as in Example 1. Incidentally, hot water of 40° C. was supplied in the jacket at a flow rate of 10 liters/minute. To the above mixer, the liquid mixture was supplied in a period of 4 minutes. After the added mixture was agitated for 6 minutes, 3 parts by weight of the amorphous aluminosilicate were supplied as a surface coating agent. After the obtained mixture was agitated for 1.5 minutes, the resulting crystalline alkali metal silicate granules were discharged. The evaluation results for the resulting crystalline alkali metal silicate granules are shown in Table 3.

EXAMPLES 5, 6 AND 7

The starting materials for each of the Examples listed in Table 1 were subjected to a granulation treatment and a surface-coating treatment in the same manner as in Example 2, to give crystalline alkali metal silicate granules. The compositions and the evaluation results for the resulting crystalline alkali metal silicate granules are shown in Tables 1 and 3.

EXAMPLE 8

A slurry having a water content of 50% by weight was spray-dried to give spray-dried particles having the following composition.

| | |
|---|---|
| ZEOLITE 4A | 15 parts by weight |
| Sodium sulfate | 5 parts by weight |
| Sodium sulfite | 2 parts by weight |
| Sodium polyacrylate | 2 parts by weight |
| Water | 1 part by weight |

Using the spray-dried particles obtained above, the starting materials listed in Table 1 were subjected to a granulation treatment and a surface-coating treatment in the same manner as in Example 2, to give crystalline alkali metal silicate granules. The composition and the evaluation results for the resulting crystalline alkali metal silicate granules are shown in Tables 1 and 3.

EXAMPLE 9

20 parts by weight of a nonionic surfactant and 10 parts by weight of a fatty acid listed in Table 2 were blended while heating the mixture to a temperature of 70° C., to prepare a liquid mixture. Next, 30 parts by weight of the liquid mixture and 70 parts by weight of the crystalline alkali metal silicate were continuously supplied and blended in FLEXO-MIX 160 (manufactured by Powrex Corp.). At this time, the entire amount supplied was 250 kg/hr, and a rotational speed of the main shaft was 3000 rpm. Also, the liquid mixture was sprayed to the above mixture in the mixer using a one-fluid nozzle at a pressure of 2 kg/cm$^2$. Next, the blended detergent starting materials were continuously supplied in Lödige Mixer "KM-150D" (manufactured by Matsuzaka Giken Co., Ltd.; equipped with a jacket) to carry out granulation. At this time, the rotational speed of the main shaft was 105 rpm, the rotational speed of the chopper was 3440 rpm, and hot water of 75° C. was supplied in the jacket at a flow rate of 10 liters/minute. Incidentally, the average residence time was 6.1 minutes.

Further, 100 parts by weight of the detergent granules starting materials obtained above and 3 parts by weight of the amorphous aluminosilicate were continuously supplied and blended in a continuous mixer having the same construction as the Lödige Mixer mentioned above (capacity 40 liters; manufactured by Kao Corporation), to give crystalline alkali metal silicate granules. At this time, the rotational speed of the main shaft was 130 rpm, the rotational speed of the chopper was 4000 rpm, and hot water of 75° C. was supplied in the jacket at a flow rate of 10 liters/minute. Incidentally, the average residence time was 1.5 minutes. The composition and the evaluation results for the resulting crystalline alkali metal silicate granules are shown in Tables 2 and 3.

EXAMPLE 10

Detergent starting materials having the same composition as in Example 9 were continuously supplied in Lodige Mixer "KM-150D" (manufactured by Matsuzaka Giken Co., Ltd.; equipped with a jacket) to simultaneously carry out blending and granulation. At this time, the entire amount supplied was 250 kg/hr, and a rotational speed of the main shaft was 105 rpm and a rotational speed of the chopper was 3440 rpm, and hot water of 75° C. was supplied in the jacket at a flow rate of 10 liters/minute. Incidentally, the average residence time was 6.0 minutes. Also, the liquid mixture was sprayed to the above mixture in the mixer using a one-fluid nozzle at a pressure of 2 kg/cm$^2$. Incidentally, the step for coating the granules was carried out in the same manner as in Example 9, to give crystalline alkali metal silicate granules. The composition and the evaluation results for the resulting crystalline alkali metal silicate granules are shown in Tables 2 and 4.

EXAMPLE 11

The starting materials listed in Table 2 were subjected to a granulation treatment and a surface-coating treatment in the same manner as in Example 2, to give crystalline alkali metal silicate granules. The composition and the evaluation results for the resulting crystalline alkali metal silicate granules are shown in Tables 2 and 4.

Comparative Example 1

The starting materials listed in Table 2 were subjected to a granulation treatment and a surface-coating treatment in the same manner as in Example 2, to give crystalline alkali metal silicate granules. The composition and the evaluation results for the resulting crystalline alkali metal silicate granules are shown in Tables 2 and 4. Incidentally, cold water of 10° C. was supplied in the jacket at a flow rate of 10 liters/minute. Also, the agitation time after adding the nonionic surfactant was 6 minutes. In addition, the agitation time upon surface coating was 1.5 minutes.

Comparative Example 2

The powdery starting material, namely the crystalline alkali metal silicate, listed in Table 2 was supplied in Nauta Mixer (manufactured by Hosokawa Micron Corp.; capacity: 30 liters; equipped with a jacket), and agitation (20 rpm) was initiated. Incidentally, hot water of 75° C. was supplied in the jacket at a flow rate of 10 liters/minute. To the above mixer, a liquid mixture comprising a nonionic surfactant and a fatty acid was added while agitating in a period of 4 minutes. Thereafter, the added mixture was agitated for 20 minutes. Further, 3 parts by weight of the amorphous aluminosilicate used as a surface coating agent were supplied in the above mixer. After the obtained mixture was agitated for 1.5 minutes, the resulting coated crystalline alkali metal silicate granules were discharged. The entire amount supplied was 5 kg. The composition and the evaluation results for the resulting crystalline alkali metal silicate granules are shown-in Tables 2 and 4.

Comparative Example 3

The starting materials listed in Table 2 were subjected to a granulation treatment and a surface-coating treatment in the same manner as in Example 2, to give crystalline alkali metal silicate granules. The composition and the evaluation results for the resulting crystalline alkali metal silicate granules are shown in Tables 2 and 4.

Comparative Example 4

The starting materials listed in Table 2 were subjected to a granulation treatment and a surface-coating treatment in the same manner as in Example 2, to give crystalline alkali metal silicate granules. The composition and the evaluation results for the resulting crystalline alkali metal silicate granules are shown in Tables 2 and 4.

Comparative Example 5

The starting materials listed in Table 2 were subjected to a granulation treatment and a surface-coating treatment in the same manner as in Example 2, to give crystalline alkali metal silicate granules. The composition and the evaluation results for the resulting crystalline alkali metal silicate granules are shown in Tables 2 and 4.

The resulting crystalline alkali metal silicate granules obtained in each of Examples and Comparative Examples were evaluated by the following methods.

Here, the bulk density was measured by a method according to JIS K 3362. The average particle size was measured by vibrating standard sieves according to JIS Z 8801 vibrated for 5 minutes to calculate a weight percentage depending upon the size opening of the sieves. The flowability of the crystalline alkali metal silicate granules was evaluated by the time required for dropping 100 ml of powder from a hopper used in a measurement of bulk density according to JIS K 3362.

The testing method for caking property was as follows.

Caking Test Method

A lidless box having dimensions of 10.2 cm in length, 6.2 cm in width, and 4 cm in height was made out of a filter paper (TOYO FILTER PAPER NO. 2) by stapling the filter paper at four corners. A 50 g sample was placed in this box, and an acrylic resin plate with a weight of 15 g and a lead plate (or an iron plate) with a weight of 250 g were placed on the sample. The above box was maintained in a thermostat kept at a constant humidity under conditions of a temperature of 30° C. and a humidity of 80%, the caking conditions after 7 days and after one month were evaluated by calculating the permeability as explained below.

[Permeability]

A sample obtained after the treatment in a thermostat mentioned above was carefully placed on a wire net (or a sieve, with 5 mm×5 mm meshes), and the weight of the powder passing through the wire net was measured. The permeability, based on the sample obtained after treatment in a thermostat was calculated by the following equation:

$$\text{Permeability}\,(\%) = \frac{\text{Weight of Powder Passing Through Wire Net (g)}}{\text{Weight of Sample Obtained after Treatment (g)}} \times 100$$

In addition, the testing method for exudation property was as follows.

Exudation Test Method

The exudation conditions were evaluated by a gross examination of a liquid mixture comprising a nonionic surfactant and a fatty acid on the bottom portion of the box obtained after the caking test, the examination being made from a side where the powder is not contacted therewith. The evaluation for exudation property was made based on the area of wetted portion occupying the bottom portion of the box in 1 to 5 ranks. Each of the ranks were determined as follows:

Rank 1: Not wetted.
2: About one-quarter of the area being wetted.
3: About one-half the area being wetted.
4: About three-quarter of the area being wetted.
5: The entire area being wetted.

The percentage of weight gain is obtained by measuring the weight of the sample after the evaluation of the caking conditions after 7-day storage, and expressing the amount of weight gain based on the starting sample in percentage (%)

The solubility is determined by obtaining the filtration residual ratio (%) on a dry basis by taking a 0.83 g sample, adding the sample to one liter of tap water at 10° C., agitating the mixed solution with a magnetic stirrer, filtering through a 200-mesh metal gauze, and then drying the residue. Here, the term "the solubilities at start and after passage of time" means solubilities before subjecting the samples to the caking test and after a 7-day storage for the caking test.

The water content in the crystalline alkali metal silicate granules was measured as follows. A three gram-sample was placed on a weighing plate, and the sample was dried for 2 hours at 105° C. with an electric dryer. The weight loss by drying was measured and expressed in percentage.

The particle breaking strength was evaluated as follows.

The crystalline alkali metal silicate granules of a particle size of 1000 to 1400 $\mu$m were selected with sieves, and among which a granule randomly selected was chosen and breaking load of the granule was measured by using a rheometer. In the same manner, the above procedure was repeated for ten granules, and the breaking load for each granule was measured. The ten breaking load values were averaged.

The blocking property was evaluated as follows.

In a lidless, metallic, cylindrical container with a 5 cm-diameter and a 15 cm-height, a 250 g sample was placed, and the sample was dropped with the container five times from a height 5 cm higher than the level. The sample-containing container subjected to dropping was kept standing in an atmosphere at 40° C. for 24 hours, and then kept standing in an atmosphere at 5° C. for 24 hours. The blocking property was evaluated by the remaining ratio calculated as follows.

<Remaining Ratio>

The container containing the sample being subjected to standing as described above was gently placed up-side-down on a vat, and the weight of the sample powder dropping from the vat was measured. From the weight of the sample powder dropped from the container and the initial weight of the sample (250 g), the proportion of the samples remaining in the container and not being dropped was calculated. The value was expressed in percentage as remaining ratio.

TABLE 1

| Composition (parts by weight) | | Example Nos. 1 | 2 | 3 | 4 | 5 | 6 | 7 | 8 |
|---|---|---|---|---|---|---|---|---|---|
| Nonionic Surfactant | Polyoxyethylene dodecyl ether | 20 | 20 | 20 | 20 | 25 | 30 | 20 | 20 |
| Fatty Acid | Palmitic Acid | 15 | 10 | 10 | — | 20 | 20 | 10 | 10 |
| Alkylsulfuric acid | Laurylsulfuric acid | — | — | — | 15 | — | — | — | — |
| Crystalline Alkali Metal Silicate | $Na_2O.2SiO_2$ (Average Particle Size: 30 μm) | 65 | 70 | 70 | 65 | — | 30 | 40 | 40 |
| | $Na_2O.2SiO_2$ (Average Particle Size: 5 μm) | — | — | — | — | 55 | — | — | — |
| Powdery Builder | Tripolyphosphate | — | — | — | — | — | — | 25 | — |
| Spray-Dried Particles | ZEOLITE 4A | — | — | — | — | — | — | — | 15 |
| | Sodium Sulfate | — | — | — | — | — | — | — | 5 |
| | Sodium Sulfite | — | — | — | — | — | — | — | 2 |
| | Sodium Polyacrylate | — | — | — | — | — | — | — | 2 |
| | Water | — | — | — | — | — | — | — | 1 |
| Porous Oil-Absorbing Carrier | Amorphous Aluminosilicate (Average Particle Size: 10 μm) | — | — | — | — | — | 20 | 5 | 5 |
| Surface Coating Agent | Amorphous Aluminosilicate (Average Particle Size: 10 μm) | — | 3 | 3 | 3 | 3 | 3 | 3 | 3 |

TABLE 2

| Composition (parts by weight) | | Example Nos. 9 | 10 | 11 | Comparative Example Nos. 1 | 2 | 3 | 4 | 5 |
|---|---|---|---|---|---|---|---|---|---|
| Nonionic Surfactant | Polyoxyethylene dodecyl ether | 20 | 20 | 20 | 20 | — | 20 | 20 | 25 |
| Aqueous Nonionic Surfactant Solution | Polyoxyethylene dodecyl ether Water Content: 10% by weight | — | — | — | — | 20 | — | — | — |
| Fatty Acid | Palmitic Acid | 10 | 10 | 10 | 10 | 10 | — | — | — |
| Soap | Sodium Palmitate (Average Particle Size: 20 μm) | — | — | — | — | — | 10 | — | — |
| Linear Alkylbenzene-sulfonic Acid | Dodecylbenzenesulfonic Acid | — | — | — | — | — | — | 10 | — |
| Crystalline Alkali Metal Silicate | $Na_2O.2SiO_2$ (Average Particle Size: 30 μm) | 70 | 70 | — | 70 | 70 | 70 | 70 | 75 |
| | $Na_2O.2SiO_2$ (Average Particle Size: 200 μm) | — | — | 70 | — | — | — | — | — |
| Surface Coating Agent | Amorphous Aluminosilicate (Average Particle Size: 10 μm) | 3 | 3 | 3 | 3 | 3 | 3 | 3 | 3 |

TABLE 3

| | Example Nos. 1 | 2 | 3 | 4 | 5 | 6 | 7 | 8 | 9 |
|---|---|---|---|---|---|---|---|---|---|
| Jacket Temp. (° C.) | 75 | 75 | 75 | 40 | 75 | 75 | 75 | 75 | 75 |
| Bulk Density (g/ml) | 0.81 | 0.83 | 0.83 | 0.83 | 0.83 | 0.81 | 0.84 | 0.83 | 0.81 |
| Average Particle Size (μm) | 443 | 425 | 423 | 415 | 418 | 391 | 410 | 426 | 402 |
| Flowability (sec) | 7.2 | 6.9 | 6.9 | 7.2 | 7.0 | 6.8 | 6.6 | 6.9 | 6.8 |
| Caking Property*1 (%) | 100 | 100 | 100 | 100 | 100 | 100 | 100 | 100 | 100 |
| Caking Property*2 (%) | 68 | 70 | 71 | 65 | 80 | 83 | 72 | 70 | 73 |

TABLE 3-continued

| | Example Nos. | | | | | | | | |
|---|---|---|---|---|---|---|---|---|---|
| | 1 | 2 | 3 | 4 | 5 | 6 | 7 | 8 | 9 |
| Exudation Property*1 | 1–2 | 1–2 | 1–2 | 1–2 | 1–2 | 1–2 | 1–2 | 1–2 | 1–2 |
| Exudation Property*2 | 4 | 3–4 | 3–4 | 3–4 | 3 | 3 | 3–4 | 3–4 | 3–4 |
| Percentage of Weight Gain (%) | 4 | 2 | 3 | 3 | 4 | 2 | 2 | 2 | 3 |
| Solubility | | | | | | | | | |
| At Start (%) | 0.1 | 0.1 | 0.1 | 0.1 | 0.1 | 0.1 | 0.1 | 0.1 | 0.1 |
| After Passage of Time (%) | 0.4 | 0.2 | 0.3 | 0.3 | 0.4 | 0.2 | 0.2 | 0.2 | 0.3 |
| Particle Breaking Strength (gf) | 25 | 32 | 38 | 32 | 40 | 42 | 35 | 30 | 34 |
| Blocking Property (%) | 90 | 80 | 85 | 90 | 75 | 70 | 95 | 90 | 95 |
| Water Content*3 (%) | 0.5 | 0.6 | 0.6 | 0.7 | 0.5 | 2.9 | 0.8 | 2.1 | 0.4 |

*1Tested after seven-day storage.
*2Tested after one-month storage.
*3Water content of the granules.

TABLE 4

| | Example Nos. | | Comparative Example Nos. | | | | |
|---|---|---|---|---|---|---|---|
| | 10 | 11 | 1 | 2 | 3 | 4 | 5 |
| Jacket Temp. (° C.) | 75 | 75 | 10 | 75 | 75 | 75 | 75 |
| Bulk Density (g/ml) | 0.83 | 0.75 | 0.75 | 0.83 | 0.75 | 0.73 | 0.66 |
| Average Particle Size (μm) | 428 | 451 | 529 | 417 | 450 | 513 | 240 |
| Flowability (sec) | 6.9 | 7.0 | 10.4 | 7.0 | 10.2 | 10.0 | No Cascading |
| Caking Property*1 (%) | 100 | 100 | 83 | 72 | 67 | 66 | 73 |
| Caking Property*2 (%) | 74 | 76 | 48 | 35 | 31 | 30 | 46 |
| Exudation Property*1 | 1–2 | 1–2 | 4–5 | 1–2 | 4–5 | 4–5 | 4–5 |
| Exudation Property*2 | 3–4 | 3–4 | 5 | 3–4 | 5 | 5 | 5 |
| Percentage of Weight Gain (%) | 2 | 3 | 8 | 10 | 16 | 12 | 14 |
| Solubility | | | | | | | |
| At Start (%) | 0.1 | 3.1 | 0.7 | 0.1 | 3.2 | 0.1 | 0.1 |
| After Passage of Time (%) | 0.2 | 3.6 | 1.4 | 2.2 | 5.1 | 2.3 | 3.4 |
| Particle Breaking Strength (gf) | 38 | 26 | 20 | 32 | 18 | 30 | 21 |
| Blocking Property (%) | 90 | 80 | 100 | 100 | 100 | 100 | 100 |
| Water Content*3 (%) | 0.6 | 0.4 | 0.8 | 2.4 | 0.5 | 0.9 | 0.4 |

*1Tested after seven-day storage.
*2Tested after one-month storage.
*3Water content of the granules.

As is clear from the above results, the crystalline alkali metal silicate granules of Examples 1 to 10 obtainable by the method of the present invention had high bulk density and excellent flowability. Further, they had good non-caking properties, were free from exudation, and had low percentage of weight gain and high solubility, so that the properties undergo only a slight deterioration even when stored under high-temperature, high-humidity conditions. Also, the crystalline alkali metal silicate granules obtained in Example 11 had slightly poor solubility owing to its relatively large average particle size, but were excellent in all other properties.

On the other hand, in the case of Comparative Example 1 where the granulation was carried out at a low temperature of 10° C., the obtained detergent granules had poor flowability and exudation property. Also, in the case of Comparative Example 2 where the water content in the nonionic surfactant exceeds 1% by weight, the non-caking properties was poor and the percentage of weight gain was high. The flowability, the blocking property, the non-caking properties, and the exudation property were poor, the percentage of weight gain was high, and the solubility was low in each of the following cases: Comparative Example 3, where the detergent granules are obtained by formulating a soap in place of an acid precursor; Comparative Example 4, where the detergent granules are obtained by formulating an acid precursor of an anionic surfactant (linear alkylbenezene-sulfonic acid), which does not have a lamellar orientation; and Comparative Example 5, where the detergent granules are obtained without formulating an acid precursor of an anionic surfactant (fatty acid) capable of having a lamellar orientation.

EXAMPLE 12

18 parts by weight of a nonionic surfactant, 2 parts by weight of a polyethylene glycol, and 15 parts by weight of a fatty acid, which were listed in Table 5, were blended while heating the mixture to a temperature of 75° C., to prepare a liquid mixture. Next, 65 parts by weight of crystalline alkali metal silicate were supplied in Lödige Mixer (manufactured by Matsuzaka Giken Co., Ltd.; capacity: 20 liters; equipped with a jacket), and agitation was initiated with the mixer having a main axis (150 rpm) and a chopper (4,000 rpm). Incidentally, hot water of 75° C. was supplied in the jacket at a flow rate of 10 liters/minute. To the above mixer, the liquid mixture was added in a period of 4 minutes, and then the added mixture was agitated for 6 minutes. Thereafter, 3 parts by weight of the amorphous aluminosilicate used as a surface coating agent were supplied in the Lödige Mixer used above containing the crystalline alkali metal silicate granules. After the obtained mixture was agitated for 1.5 minutes, the resulting crystalline alkali metal silicate granules were discharged. The entire amount supplied was 4 kg. The evaluation results for the resulting crystalline alkali metal silicate granules are shown in Table 6.

EXAMPLE 13

18 parts by weight of a nonionic surfactant and 2 parts by weight of a polyethylene glycol, which were listed in Table 5, were blended while heating the mixture to a temperature of 75° C., to prepare a liquid mixture. Next, 70 parts by weight of crystalline alkali metal silicate were supplied in L ödige Mixer (manufactured by Matsuzaka Giken Co., Ltd.; capacity: 20 liters; equipped with a jacket), and agitation was initiated with the mixer having a main axis (150 rpm) and a chopper (4,000 rpm). Incidentally, heated water of 75° C. was supplied in the jacket at a flow rate of 10 liters/minute. To the above mixer, the liquid mixture was supplied in a period of 2.5 minutes, and after the added mixture was agitated for 4 minutes. Next, 10 parts by weight of a fatty acid listed in Table 5 were supplied to the mixer in a period of 1.5 minutes, and then the mixture was agitated for another 6 minutes. Thereafter, 3 parts by weight of the amorphous aluminosilicate used as a surface coating agent were supplied in the Lödige Mixer used above containing the crystalline alkali metal silicate granules. After the obtained mixture was agitated for 1.5 minutes, the resulting crystalline alkali metal silicate granules were discharged. The entire amount supplied was 4 kg. The evaluation results for the resulting crystalline alkali metal silicate granules are shown in Table 6.

TABLE 5

| Composition (parts by weight) | | Example Nos. 12 | 13 |
|---|---|---|---|
| Nonionic Surfactant | Polyoxyethylene dodecyl ether | 18 | 18 |
| Polyethylene Glycol | PEG 6000 (Weight-Average Molecular Weight: 8500) | 2 | 2 |
| Fatty Acid | Palmitic Acid | 10 | 10 |
| Crystalline Alkali Metal Silicate | $Na_2O \cdot 2SiO_2$ (Average Particle Size: 30 $\mu$m) | 70 | 70 |
| Surface Coating Agent | Amorphous Aluminosilicate (Average Particle Size: 10 $\mu$m) | 3 | 3 |

TABLE 6

| | Example Nos. 12 | 13 |
|---|---|---|
| Jacket Temp. (° C.) | 75 | 75 |
| Bulk Density (g/ml) | 0.87 | 0.87 |
| Average Particle Size ($\mu$m) | 420 | 425 |
| Flowability (sec) | 5.9 | 5.9 |
| Caking Property*1(%) | 100 | 100 |
| Caking Property*2(%) | 100 | 96 |
| Exudation Property*1 | 1 | 1 |
| Exudation Property*2 | 1~2 | 1~2 |
| Percentage of Weight Gain (%) | 1.8 | 2.4 |
| Solubility | | |
| At Start (%) | 0.1 | 0.1 |
| After Passage of Time (%) | 0.2 | 0.3 |
| Particle Breaking Strength (gf) | 57 | 55 |
| Blocking Property (%) | 0 | 0 |
| Water Content*3 (%) | 0.7 | 0.7 |

*1Tested after seven-day storage.
*2Tested after one-month storage.
*3Water content of the granules.

As is clear from the above results, by adding a water-soluble nonionic organic compound (PEG6000, manufactured by KAO Corporation) having a weight-average molecular weight of 1000 or more and a melting point of 45° C. or higher to the detergent starting material mixture, the long-term storage stability (caking property and exudation property after one-month storage), the particle strength, and the blocking property of the resulting crystalline alkali metal silicate granules became even more excellent.

Further, the granular detergent composition of the present invention will be further described by means of the following preparation examples and test examples, without intending to restrict the scope of the present invention thereto.

The measurements shown in Preparation Examples were obtained as follows:

(1) Ion Capturing Capacity

The ion capturing ability was measured by the following different methods in accordance to a case where the materials used having a metal ion capturing capacity are ion exchange materials and are chelating agents. In addition, the DH water hardness was measured by ion-coupling plasma method (ICP method).

Ion Exchange Materials

A 0.1 g sample was accurately weighed and added to 100 ml of a calcium chloride aqueous solution (500 ppm concentration, when calculated as $CaCO_3$), followed by stirring at 25° C. for 60 minutes, after which the mixture was filtered using a membrane filter (made of nitrocellulose; manufactured by Advantech) with 0.2 $\mu$m pore size. 10 ml of the filtrate was assayed for Ca content by an EDTA titration, and the calcium ion exchange capacity (cationic exchange capacity) of the sample was calculated from the titer.

Chelating Agents

The calcium ion capturing capacity was measured by the following method using a calcium ion electrode.

Incidentally, the solution used herein was prepared with the following buffer solution:

Buffer: 0.1 M—$NH_4Cl$—$NH_4OH$ solution (pH 10.0)

(i) Preparation of Calibration Curve

A standard calcium ion solution was prepared and used for obtaining a calibration curve showing the relationships between the logarithm of the calcium ion concentration and the voltage, as shown in FIG. 1.

(ii) Measurement of Calcium Ion Capturing Capacity

Figure 2:
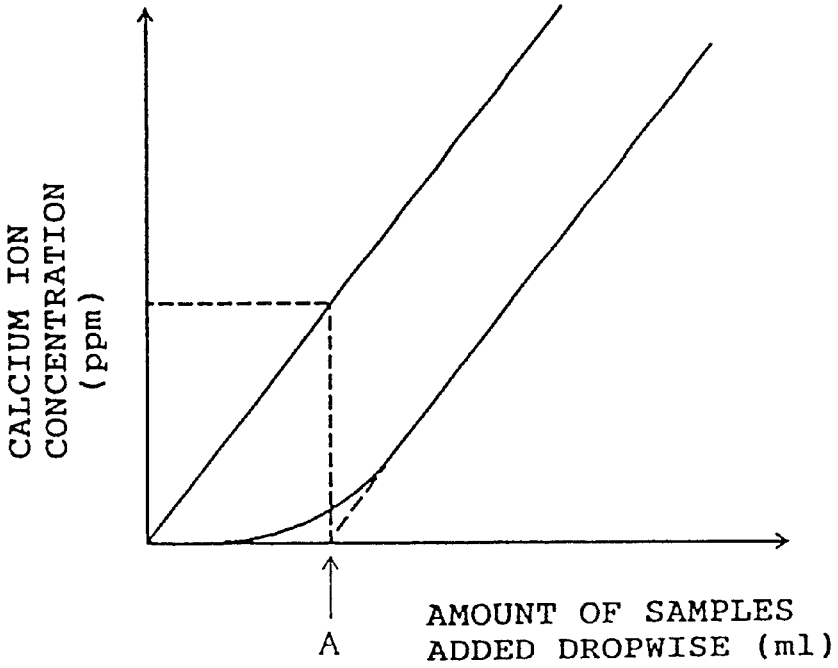
FIG. 2 is a graph showing the relationships between the amount of samples added dropwise and the calcium ion concentration.

About a 0.1 g sample was weighed into a 100 ml volumetric flask, and the volumetric flask was filled up to a volume of 100 ml with the above buffer solution. A $CaCl_2$ aqueous solution (pH 10.0) having a concentration of 20,000 ppm calculated as $CaCO_3$ was added dropwise from a burette in an amount of 0.1 to 0.2 ml for reading each sample voltage. A blank sample was also measured. Thus, a calcium ion concentration was calculated from the calibration curve given in FIG. 1 by applying a sample voltage. The calcium ion concentration of the upper line corresponding to the amount A of samples added dropwise shown in FIG. 2 was referred to as calcium ion capturing capacity.

(2) Average Particle Size and Particle Size Distribution of Crystalline Alkali Metal Silicates The average particle size and the particle size distribution were measured by using a laser scattering particle size distribution analyzer. Specifically, about 200 ml of ethanol was poured into a measurement cell of a laser scattering particle size distribution analyzer ("LA-700," manufactured by HORIBA Ltd.), and about a 0.5 to 5 mg sample was suspended in ethanol. Next, while subjecting the sample to irradiation with an ultrasonic wave, the mixture was agitated for one minute, to thereby sufficiently disperse the sample. Thereafter, an He-Ne laser beam (632.8 nm) was irradiated, and the particle size distribution was measured from the diffraction/scattering patterns. The analysis was made based on the combined theories of Fraunhofer diffraction theory and Mie scattering theory. The particle size distribution of the suspended particles in the liquid was measured in the size range of from 0.04 to 262 $\mu$m. An average particle size was a median of the particle size distribution.

Preparation Example 1

Crystalline Alkali Metal Silicate A

To 1000 parts by weight of No. 2 sodium silicate ($SiO_2$/$Na_2O$=2.5), 55.9 parts by weight of sodium hydroxide and 8.5 parts by weight of potassium hydroxide were added, followed by stirring using a homomixer to thereby dissolve sodium hydroxide and potassium hydroxide. To this solution, 5.23 parts by weight of finely powdered anhydrous calcium carbonate and 0.13 parts by weight of magnesium nitrate hexahydrate were added, and the components were agitated by using a homomixer. A given amount of the mixture was transferred into a nickel crucible and baked in the air at a temperature of 700° C. for one hour, followed by rapid cooling. The obtained baked product was powdered, to give an alkali metal silicate A in the present invention. This powder had an average particle size of 25 $\mu$m and a high ion exchange capacity of 305 $CaCO_3$ mg/g.

Preparation Example 2

Amorphous Aluminosilicate

Sodium carbonate was dissolved in ion-exchanged water, so as to prepare an aqueous solution with 6% by weight concentration. 132 g of the above aqueous solution and 38.28 g of a sodium aluminate aqueous solution (conc. 50% by weight) were placed in a 1000-ml capacity reaction vessel equipped with baffles. 201.4 grams of a solution prepared by diluting No. 3 Water Glass with water twice were added dropwise to the above liquid mixture by under strong agitation at a temperature of 40° C. over a period of 20 minutes. Here, the reaction speed was optimized by adjusting a pH of the reaction system to a pH of 10.5 by blowing a $CO_2$ gas thereinto. Thereafter, the reaction system was heated to a temperature of 50° C. and stirred at 50° C. for 30 minutes. Subsequently, an excess alkali was neutralized by blowing a $CO_2$ gas thereinto to thereby adjust the pH of the reaction system to a pH of 9.0. The obtained neutralized slurry was filtered under a reduced pressure using a filter paper (No. 5C, manufactured by Toyo Roshi Kaisha, Ltd.). The filter cake was rinsed with water in an amount of 1000-folds, and the rinsed cake was filtered and dried under the conditions of 105° C., 300 Torr, and 10 hours. Further, the dried cake was disintegrated, to give an amorphous aluminosilicate powder with an average particle size of 10 $\mu$m in the present invention. Incidentally, the sodium aluminate aqueous solution was prepared by the steps of adding and mixing 243 g of $Al(OH)_3$ and 298.7 g of a 48% by weight NaOH aqueous solution in a 1000 ml-capacity four-necked flask, heating the mixture to a temperature of 110° C. under stirring, and maintaining the temperature of 110° C. for 30 minutes, to dissolve the components.

As shown by the results of atomic absorption spectrophotometry and plasma emission spectrochemical analysis, the resulting amorphous aluminosilicate-had the following composition: $Al_2O_3$=29.6% by weight; $SiO_2$=52.4% by weight; and $Na_2O$=18.0% by weight (1.0 $Na_2O.Al_2O_3$.3.10 $SiO_2$). In addition, the calcium ion capturing capacity was 185 $CaCO_3$ Mg/g, and the oil-absorbing capacity was 285 ml/100 g. The percentage of the microporous capacity having a microporous diameter of less than 0.1 $\mu$m was 9.4%, and the percentage of the microporous capacity having a microporous diameter of 0.1 $\mu$m or more and 2.0 $\mu$m or less was 76.3%. The water content was 11.2% by weight.

Preparation Example 3

Detergent Compositions

A 50% by weight aqueous slurry containing solid components which comprise, in a solid basis, 5.0 parts by weight of ZEOLITE 4A, 3.6 parts by weight of sodium sulfate, 1.0 part by weight of sodium sulfite, and 4.0 parts by weight of an acrylic acid-maleic acid copolymer was spray-dried, to give spray-dried particles. Of the ingredients listed in Table 7, Crystalline Alkali Metal Silicate, ZEOLITE 4A, Amorphous Aluminosilicate, and Spray-Dried Particles prepared above were supplied in Lödige Mixer (manufactured by Matsuzaka Giken Co., Ltd.; capacity: 20 liters; equipped with a jacket) in proportions given in Table 7, and agitation was carried out while keeping the jacket at a temperature of 75° C. To the above powdery ingredients, a polyoxyethylene alkyl ether and a fatty acid, each being listed in Table 7, each heated to 75° C., were simultaneously supplied in the mixer containing the powdery ingredients, while agitating the ingredients in a period of 4 minutes. Here, the agitation was carried out with the mixer having a main axis (150 rpm) and a chopper (4,000 rpm). Thereafter, the granulation was carried out by agitating the ingredients for 6 minutes after completing the addition of the polyoxyethylene alkyl ether and the fatty acid. After obtaining suitable granules, ZEOLITE 4A used as a surface coating agent was supplied in the mixer, and the obtained mixture was agitated for 1.5 minutes, to give a surface-coated granular detergent composition of the present invention. The bulk density of the resulting granular detergent composition is shown in Table 7.

Test Example 1

Detergent Compositions obtained in the Preparation Examples mentioned above were used to carry out a detergency test under the following conditions:

Preparation of Artificially Stained Cloth

An artificial staining liquid having the following compositions was adhered to a cloth (#2003 calico, manufactured by Tanigashira Shoten) to prepare an artificially stained cloth. Artificial staining liquid was printed on a cloth by an engravure staining machine equipped with an engravure roll coater. The process for adhering the artificial staining liquid to a cloth to prepare an artificially stained cloth was carried out under the conditions of a cell capacity of a gravure roll of 58 $cm^3/cm^2$, a coating speed of 1.0 m/min, a drying temperature of 100° C., and a drying time of one minute.

Composition of Artificial Staining Liquid

| | |
|---|---|
| Lauric acid | 0.44% by weight |
| Myristic acid | 3.09% by weight |
| Pentadecanoic acid | 2.31% by weight |
| Palmitic acid | 6.18% by weight |
| Heptadecanoic acid | 0.44% by weight |
| Stearic acid | 1.57% by weight |
| Oleic acid | 7.75% by weight |
| Triolein | 13.06% by weight |
| n-Hexadecyl palmitate | 2.18% by weight |
| Squalene | 6.53% by weight |
| Egg white lecithin crystalline liquid | 1.94% by weight |
| Kanuma sekigyoku soil | 8.11% by weight |
| Carbon black | 0.01% by weight |
| Tap water | Balance |

Washing Conditions

Washing of the above-mentioned artificially stained cloth in 4° DH water (Ca/Mg=3/1) was carried out by using terg-o-meter at a rotational speed of 100 rpm, at a temperature of 20° C. for 10 minutes, in which washing was carried out at two kinds of detergent concentrations of 0.67 g/L and 0.50 g/L. Incidentally, the typical water hardness components in the water for washing are $Ca^{2+}$ and $Mg^{2+}$, whose weight ratios are generally in the range of Ca/Mg=(60–85)/(40–15). Here, a model sample of water of Ca/Mg=3/1 was used. The unit "° DH" refers to a water hardness which was calculated by replacing Mg ions with equimolar amounts of Ca ions.

Calculation of Detergency Rate

Reflectivities of the original cloth and those of the stained cloth before and after washing were measured at 550 mμ by means of an automatic recording colorimeter (manufactured by Shimadzu Corporation), and the detergency rate D (%) was calculated by the following equation. The results thereof are shown in Table 7.

$$D = \frac{(L_2 - L_1)}{(L_0 - L_1)} \times 100(\%),$$

wherein $L_0$: Reflectivity of the original cloth;

$L_1$: Reflectivity of the stained cloth before washing; and $L_2$: Reflectivity of the stained cloth after washing.

Incidentally, the materials shown in Table 7 are as follows:

Polyoxyethylene alkyl ether: "EMULGEN 108KM" (manufactured by Kao Corporation), which is alkylene oxide adducts of alcohols each having from 12 to 14 carbon atoms, each of the ethylene oxide adducts having an average molar amount of 8.5.

Fatty acid: Palmitic acid (content: 95% by weight or more).

ZEOLITE 4A-TYPE: Average particle size: 3.5 μm.

Acrylic acid maleic acid copolymer: Degree of neutralization: 80 mol %, weight-average molecular weight: 70,000.

Crystalline Alkali Metal Silicate B: "SKS-6" (manufactured by Hoechst; $SiO_2/Na_2O$ molar ratio= 2.0; shown in the general formula (4)), powdered to a size of 23 μm.

TABLE 7

| Composition | | Inventive Product | | Comparative Product | | |
|---|---|---|---|---|---|---|
| (Parts by Weight) | CEC | 1 | 2 | 1 | 2 | 3 |
| (I) Fatty Acid | | 10.00 | 10.00 | 10.00 | 10.00 | 0.00 |
| Polyoxyethylene alkyl ether (C12–14) | | 16.67 | 16.67 | 16.67 | 30.00 | 16.67 |
| (II) Crystalline Alkali Metal Silicate A | 305 | 40.00 | 0.00 | 63.40 | 16.67 | 0.00 |
| Crystalline Alkali Metal Silicate B | 224 | 0.00 | 40.00 | 0.00 | 0.00 | 40.00 |
| (III) Acrylic Acid/Maleic Acid Copolymer | 380 | 6.67 | 6.67 | 0.83 | 6.67 | 6.67 |
| Sodium Polyacrylate | 220 | 0.00 | 0.00 | 0.00 | 0.00 | 0.00 |
| Zeolite (Spraying Base) | 280 | 8.33 | 8.33 | 1.05 | 8.33 | 8.33 |
| Zeolite (Surface Coating) | 280 | 6.67 | 6.67 | 5.35 | 6.67 | 6.67 |
| Amorphous Aluminosilicate (Oil-Absorbing Carrier) | | 3.33 | 3.33 | 1.67 | 13.33 | 3.33 |
| Sodium Sulfate | | 6.00 | 6.00 | 0.75 | 6.00 | 6.00 |
| Sodium Sulfite | | 1.67 | 1.67 | 0.20 | 1.67 | 1.67 |
| Water Content | | 0.66 | 0.66 | 0.08 | 0.66 | 0.66 |
| Total Amount (Parts by Weight) | | 100.00 | 100.00 | 100.00 | 100.00 | 90.00 |
| The Resulting Granules | | | | | | |
| Average Particle Size (μm) | | 410 | 395 | 345 | 478 | 831 |
| Bulk Density (g/L) | | 845 | 831 | 871 | 805 | 857 |

TABLE 7-continued

| Composition | Inventive Product | | | Comparative Product | | |
|---|---|---|---|---|---|---|
| (Parts by Weight) | CEC | 1 | 2 | 1 | 2 | 3 |
| Detergency at Conc. of 0.67 g/L (%) | | 69.5 | 67.8 | 62.5 | 58.9 | 64.8 |
| Detergency at Conc. of 0.50 g/L (%) | | 63.7 | 62.4 | 57.8 | 52.4 | 60.9 |

CEC: Calcium Ion Capturing Ability ($CaCO_3$ mg/g)

As is clear from the results, the products of the present invention had high detergency, showing a detergency higher than 60% even at a detergent concentration of 0.50 g/L. On the other hand, the comparative products all showed low detergency, achieving a low detergency with a detergent concentration of 0.50 g/L.

Test Example 2

The powder properties of the detergents having each of the compositions shown in Table 7 were studied. Inventive Products 1 and 2 had no exudation of the polyoxyethylene alkyl ether, and were rigid and had excellent flowability. On the other hand, Comparative Product 3 was barely able to be formed into granules, and it was easily exudated, thereby showing drastically poor flowability, and was easily broken owing to its weak particle strength.

Therefore, the present invention provides a granular detergent composition having excellent detergency with a small amount of dosage of the detergents and excellent powder flowability.

INDUSTRIAL APPLICABILITY

According to the method of the present invention, the crystalline alkali metal silicate granules having high bulk density, good powder flowability, excellent non-caking ability, and free from exudation can be produced, and the resulting crystalline alkali metal silicate granules have excellent properties even if stored under high-temperature, high-humidity conditions, and they were capable to control hygroscopic property and maintain high solubility. Also, the resulting crystalline alkali metal silicate granules have extremely high detergent activity and are effective in concentrating the compositions. Further, when using the crystalline alkali metal silicate granules as an additive, the degree of freedom of the compositions of the base detergents can be increased.

In addition, the present invention provides a granular detergent composition having a high bulk density with an excellent detergency even when washed with a smaller standard amount of dosage as compared to that of the conventional, compact-type clothes detergent compositions, so that the volume of the detergent package for the same number of washes as the conventional ones can be made notably smaller as compared to the conventional compact-type detergent packages. Also, the detergent composition also have excellent powder properties. Further, the washing method of the present invention using the above granular detergent compositions also give excellent detergency.

The present invention being thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A method for producing crystalline alkali metal silicate granules, comprising the following steps:

(1) preparing a mixture comprising:

(a) a crystalline alkali metal silicate comprising a composition having the general formula (1):

$$xM_2O.ySiO_2.zMe_mO_n.wH_2O, \quad (1)$$

wherein M stands for an alkali metal atom; Me stands for one or more elements selected from the group consisting of Group IIa, IIb, IIIa, IVa, and VIII; and x, y, z, and w stand for molar numbers for each component, wherein y/x is from 1.5 to 2.6, z/x is from 0.01 to 1.0, n/m is from 0.5 to 2.0, and w is from 0 to 20, wherein a maximum pH value exceeds 11.0 at 20° C. in a 0.1% by weight dispersion of the crystalline alkali metal silicate and wherein the crystalline alkali metal silicate has an ion exchange capacity of 100 $CaCO_3$ mg/g or more;

(b) a nonionic surfactant; and (c) an acid precursor of an anionic surfactant capable of having lamellar orientation; and (2) granulating by tumbling the mixture obtained in step (1) in an agitating mixer while increasing a bulk density at a temperature sufficiently high enough to neutralize said acid precursor, to thereby give crystalline alkali metal silicate granules having bulk density of from 0.6 to 1.2 g/ml, wherein an amount of component (a) in the mixture is 25% by weight or more.

2. The method according to claim 1, wherein the amount of component (a) in the entire mixture is 25% by weight or more; a total amount of component (a), component (b) and component (c) in the entire mixture is from 50 to 100% by weight; the amount of component (c) is from 25 to 100 parts by weight, based on 100 parts by weight of component (b); the weight ratio of a total amount of component (b) and component (c) to component (a), namely {(b)+(c)}/(a), is from 0.1 to 2.0.

3. The method according to claim 1, wherein said component (a) has an average particle size of from 0.1 to 100 $\mu$m.

4. The method according to claim 1, wherein said component (b) is polyoxyethylene alkyl ethers, which are ethylene oxide adducts of linear or branched, primary or secondary alcohols, whose alkyl moieties have from 10 to 20 carbon atoms, the ethylene oxide adducts having an average molar amount of from 5 to 15.

5. The method according to claim 1, wherein said component (c) is one or more compounds selected from the group consisting of saturated or unsaturated fatty acids having 10 to 22 carbon atoms; alkylsulfuric acids having 10 to 22 carbon atoms; $\alpha$-sulfonated fatty acids having 10 to 22 carbon atoms; and polyoxyethylene alkyl ether sulfuric acids whose alkyl moieties have 10 to 22 carbon atoms and whose ethylene oxide moieties have an average additional molar number of from 0.2 to 20.

6. The method according to claim 1, wherein the mixture further comprises one or more compounds selected from the group consisting of powdery builders, porous oil-absorbing carriers, recontamination preventatives, enzymes, and fluorescents.

7. The method according to claim 1, wherein each of said component (a), said component (b), and said component (c) has a water content of 1% by weight or less.

8. The method according to claim 1, wherein the mixture is prepared in step (1) by adding component (c) to the agitating mixer in any one of the following embodiments:

(i) Embodiment where component (b) and component (c) are blended in advance, and then the mixture is supplied in the agitating mixer;

(ii) Embodiment where component (b) and component (c) are supplied in the agitating mixer without mixing in advance; or (iii) Embodiment where component (c) is added to the agitating mixer after component (b) is added to the agitating mixer.

9. The method according to claim 1, wherein said step (2) is carried out at a temperature equal to or higher than one of the following (A) or (B):

(A) In a case of using a liquid mixture obtainable by blending component (b) and component (c) in step (1), the temperature of fusion of the liquid mixture; or (B) In a case of using component (b) and component (c) without mixing in advance in step (1), the higher one among the melting points among component (b) and component (c).

10. The method according to claim 9, wherein said step (2) is carried out in an agitating mixer equipped with a jacket capable of flowing liquids.

11. The method according to claim 1, wherein the mixture is prepared in step (1) by further adding (e) a water-soluble nonionic organic compound having a weight-average molecular weight of 1000 or more and a melting point of 45° C. or higher.

12. The method according to claim 11, wherein the amount of component (a) in the entire mixture is 25% by weight or more; a total amount of component (a), component (b), component (c) and component (e) in the entire mixture is from 50 to 100% by weight; the amount of component (c) is from 25 to 100 parts by weight, based on 100 parts by weight of component (b); the amount of component (e) is from 2 to 30 parts by weight, based on 100 parts by weight of component (b); the weight ratio of a total amount of component (b), component (c), and component (e) to component (a), namely {(b)+(c)+(e)}/(a), is from 0.1 to 2.0; and the amount of components (a)+(b)+(c)+(e) in the entire mixture is from about 50% to 100% by weight.

13. The method according to claim 11 or 12, wherein said step (2) is carried out at a temperature equal to or higher than one of the following (C), (D), or (E):

(C) in a case of using a liquid mixture obtainable by blending component (b), component (c), and component (e) in step (1), the temperature of fusion of the liquid mixture;

(D) In a case of using (i) a liquid mixture obtainable by blending at random two of the components from component (b), component (c), and component (e) together with (ii) a remaining component in step (1), the temperature of the higher one among the temperature of fusion of the liquid mixture and the melting point of the remaining component; or (E) In a case of using component (b), component (c), 10 and component (e) without mixing in advance in step (1), the highest one among the melting points among component (b), component (c) and component (e).

14. The method according to claim 13, wherein said step (2) is carried out in an agitating mixer equipped with a jacket capable of flowing liquids.

15. The method according to claim 11, wherein said component (e) has a melting point of from 45 to 100° C. and a weight-average molecular weight of from 1000 to 30000.

16. The method according to claim 15, wherein said component (e) is a polyether-based nonionic organic compound.

17. The method according to claim 15, wherein said component (e) is a polyoxyethylene-based nonionic organic compound.

18. The method according to claim 1, wherein the granulation process of step (2) is carried out in an agitating mixer comprising an agitating shaft along a center line of the horizontal cylinder and agitating impellers arranged on said agitating shaft.

19. The method according to claim 18, wherein the granulation process is carried out under the condition of a Froude number of from 1 to 12, based on the rotation of the agitating impellers arranged in the agitating mixer used in step (2).

20. The method according to claim 1, wherein said granulation process in step (2) is carried out for 2 to 20 minutes.

21. The method according to claim 1, wherein step (1) and step (2) are carried out in the same mixer.

22. The method according to claim 1, further comprising mixing the crystalline alkali metal silicate granules obtained in step (2) and fine powder, to thereby coat surfaces of the granulated product with said fine powder.

23. The method according to claim 22, wherein said fine powder has an average primary particle size of 10 $\mu$m or less, and wherein the amount of said fine powder used is from 0.5 to 20 parts by weight, based on 100 parts by weight of said crystalline alkali metal silicate granules obtained in step (2).

24. The method according to claim 22 or 23, wherein said fine powder is one or more compounds selected from the group consisting of crystalline or amorphous aluminosilicates, and calcium silicates.

25. The method according to claim 1, wherein the obtainable crystalline alkali metal silicate granules have an average particle size of from 250 to 800 $\mu$m.

26. The method according to claim 1, wherein said obtainable crystalline alkali metal silicate granules have a flowability evaluated by a flow time of not more than 10 seconds, the flow time being a time period required for dropping 100 ml of powder from a hopper used in a measurement of bulk density according to JIS K 3362.

27. The method according to claim 1, wherein said obtainable crystalline alkali metal silicate granules have a caking property evaluated by a sieve permeability of 90% or more.

28. The method according to claim 1, wherein said obtainable crystalline alkali metal silicate granules have a blocking property evaluated by a remaining ratio in the container of 20% or less.

29. The method according to claim 1, wherein the water content in the crystalline alkali metal silicate granules is 5% by weight or less.

30. The method according to claim 1, wherein the water content in the crystalline alkali metal silicate granules is 3% by weight or less.

31. The method according to claim 1, wherein the water content in the crystalline alkali metal silicate granules is 1% by weight or less.

32. A granular detergent composition for clothes washing having high bulk density, comprising the following components:

(I) surfactant components comprising:

A) a polyoxyethylene alkyl ether; and

B) an anionic surfactant capable of having a lamellar orientation, wherein a total amount of component A and component B is 80% by weight or more of the entire surfactant components, and wherein the weight ratio of component A to component B is A/B=20/1 to 1/1;

(II) C) crystalline alkali metal silicates comprising a composition having the following general formula (3):

$$xM_2O.ySiO_2.zMe_mO_n.wH_2O, \quad (3)$$

wherein M stands for an element in Group Ia of the Periodic Table; Me stands for one or more elements selected from the group consisting of Group IIa, IIb, IIIa, IVa, and VIII; and x, y, z, and w each represents a molar number, wherein y/x is from 1.5 to 2.6, z/x is from 0.01 to 1.0, n/m is from 0.5 to 2.0, and w is from 0 to 20; and (III) D) metal ion-capturing agents other than component C having a calcium ion capturing ability of 200 $CaCO_3$ mg/g or more, wherein component I, component II, and component III are present within one granule, and wherein a total amount of component I, component II and component III is from 70 to 100% by weight of the entire granular detergent composition, wherein the weight ratio of component II to component I is II/I=9/1 to 9/11, wherein the weight ratio of component II to component III is II/III=4/1 to 1/15, the granular detergent composition having a bulk density being from 0.6 to 1.2 g/ml, and wherein a gelled product carrying component A is contained in the granular detergent composition.

33. The granular detergent composition for clothes washing having high bulk density according to claim 32, wherein the weight ratio of said component A to said component B is A/B=10/1 to 4/3.

34. The granular detergent composition for clothes washing having high bulk density according to claim 32 or 33, wherein said polyoxyethylene alkyl ethers constituting component A are alkylene oxide adducts of alcohols each having an average number of carbon atoms from 10 to 18, the ethylene oxide adducts having an average molar amount of from 5 to 15.

35. The granular detergent composition for clothes washing having high bulk density according to claim 32, wherein said anionic surfactants constituting component B are one or more compounds selected from the group consisting of salts of saturated or unsaturated fatty acids having 10 to 22 carbon atoms; salts of alkylsulfuric acids having 10 to 22 carbon atoms; salts of α-sulfonated fatty acids having 10 to 22 carbon atoms, and salts of polyoxyethylene alkyl ether sulfuric acids whose alkyl moieties have 10 to 22 carbon atoms and whose ethylene oxide moieties have an average additional molar number of from 0.2 to 20.

36. The granular detergent composition for clothes washing having high bulk density according to any claim 32, wherein an amount of the crystalline alkali metal silicate constituting component C is 50 to 100% by weight of an entire alkalizer content.

37. The granular detergent composition for clothes washing having high bulk density according to claim 32, wherein granule surfaces are coated with amorphous sodium aluminosilicate.

38. The granular detergent composition for clothes washing having high bulk density according to claim 32, further comprising a water-soluble, crystalline inorganic salt, wherein the amount of said water-soluble, crystalline inorganic salt is 10% by weight or less.

39. The granular detergent composition for clothes washing having high bulk density according to claim 38, wherein said water-soluble, crystalline inorganic salt is an alkali metal carbonate or an alkali metal sulfate.

40. The granular detergent composition for clothes washing having high bulk density according to claim 32, wherein said component D comprises an aluminosilicate comprising a composition having the following general formula (5):

$$x''(M_2O).Al_2O_3.y''(SiO_2).w''(H_2O), \quad (5)$$

wherein M stands for an alkali metal atom; x", y", and w" each stands for a molar number of each component; and x" is from 0.7 to 1.5; y" is from 0.8 to 6.0; and w" is from 0 to 20.

41. The granular detergent composition for clothes washing having high bulk density according to claim 32, wherein said component D comprises a carboxylate polymer having a calcium ion capturing ability of 200 $CaCO_3$ mg/g or more.

42. The granular detergent composition for clothes washing having high bulk density according to claim 32, wherein a standard amount of dosage per one washing cycle is 10 to 20 g or 9 to 30 ml based on 30 liters of water for washing.

43. The granular detergent composition for clothes washing having high bulk density according to claim 32, wherein said granular detergent composition is obtainable by the method according to claim 1.

44. A washing method comprising the step of washing clothes using the granular detergent composition for clothes washing having high bulk density according to claim 32, at a surfactant concentration in a washing liquid of from 0.07 to 0.17 g/L.

* * * * *